US005497757A

United States Patent [19]

Osanai

[11] Patent Number: 5,497,757

[45] Date of Patent: Mar. 12, 1996

[54] APPARATUS FOR CORRECTING AMOUNT OF FUEL INJECTION OF INTERNAL COMBUSTION ENGINE IN ACCORDANCE WITH AMOUNT OF FUEL-VAPOR PURGED FROM CANISTER AND FUEL TANK

[75] Inventor: Akinori Osanai, Susono, Japan

[73] Assignee: Toyota Jidosha Kabushiki Kaisha, Toyota, Japan

[21] Appl. No.: 403,097

[22] Filed: Mar. 13, 1995

[30] Foreign Application Priority Data

Mar. 14, 1994 [JP] Japan ..... 6-042603
Mar. 8, 1995 [JP] Japan ..... 7-048491

[51] Int. Cl.[6] ..... F02D 41/14; F02M 25/08

[52] U.S. Cl. ..... 123/674; 123/698

[58] Field of Search ..... 123/674, 520, 123/698

[56] References Cited

U.S. PATENT DOCUMENTS 5,048,493 9/1991 Orzel et al. ..... 123/698 X
5,299,546 4/1994 Kato et al. ..... 123/698 X

FOREIGN PATENT DOCUMENTS 62-131962 6/1987 Japan .

*Primary Examiner*—Tony M. Argenbright
*Attorney, Agent, or Firm*—Kenyon & Kenyon

[57] ABSTRACT

A purge amount is estimated by taking the change of purge amounts of a vapor from a canister side and a fuel tank side into consideration, an amount of fuel injection is corrected by the purge amount so estimated, and air-fuel ratio control is executed with a high level of accuracy. In an apparatus for correcting an amount of fuel injection of an internal combustion engine for purging the vapor directly evaporating from the fuel tank and the vapor emitted from the canister into an intake passage through a solenoid control valve and executing an air-fuel ratio control on the basis of the total purge flow amount, a correction amount of the amount of fuel injection on the tank side, which changes with the vapor supplied directly from the fuel tank into the intake passage through the control valve is calculated and a correction amount of fuel injection on the canister side which changes by the vapor supplied from the canister to the intake passage through the control valve is calculated. The total correction amount of fuel injection after the opening of the control valve changes is anticipated on the basis of the tank side correction amount and the canister side correction amount. Air-fuel ratio feedback control means corrects the amount of injection on the basis of this total anticipated correction amount, and no disturbance occurs in the air-fuel ratio due to purging.

18 Claims, 38 Drawing Sheets

PURGE CONTROL ROUTINE

601
IS IT DUTY PERIOD ?
NO
YES
602
IS IT 1ST PURGE CONDITION ?
NO
YES
610
INITIALIZING
603
IS IT 2ND PURGE CONDITION ?
NO
YES
611
DPG ← 0
PGR ← 0
CPGR INC
604
PG100 = PGQ / QA * 100
605
606
KFAF15>FAF>KFAF85
NO
YES
606A
606B
tPGR = PGR + KPGRu ≦ (P%)
tPGR = PGR - KPGRd ≧ (s%)
DPG=(tPGR/PG100)*100≦100
607
PGR = PG100 * (DPG/100)
608
DPGO ← DPG
PGRO ← PGR
609
YES
TDPG = TIMER ?
NO
614
VSV ON
612
VSV OFF
615
TDPG←DPG+TIMER
613
END

Fig. 26
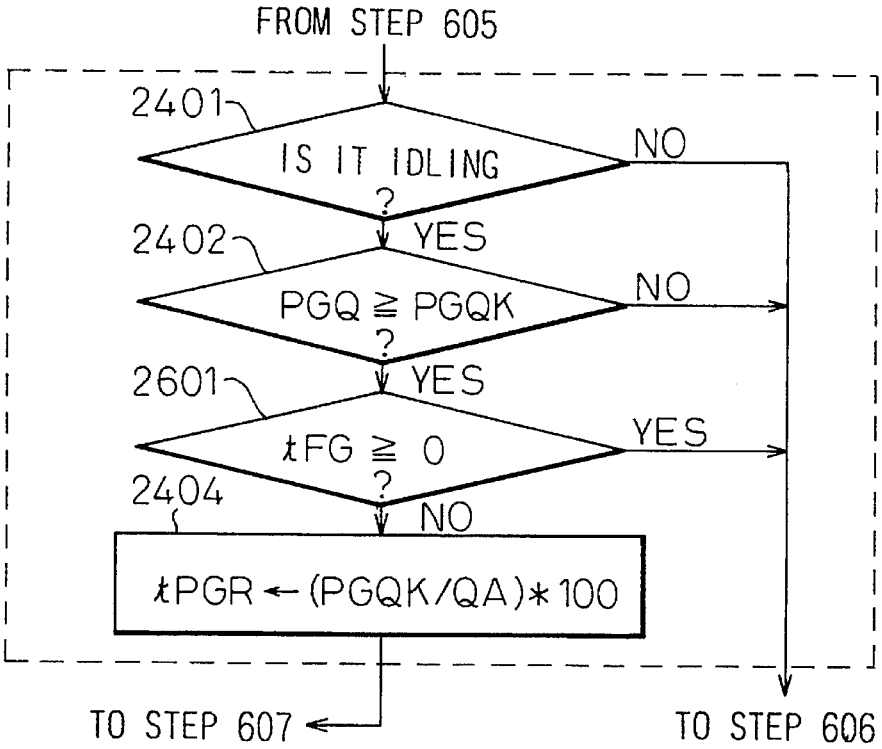
Fig. 27A
Fig. 27B
Fig. 27C
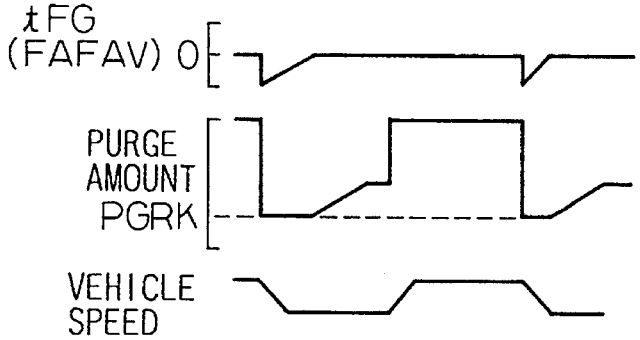

APPARATUS FOR CORRECTING AMOUNT OF FUEL INJECTION OF INTERNAL COMBUSTION ENGINE IN ACCORDANCE WITH AMOUNT OF FUEL-VAPOR PURGED FROM CANISTER AND FUEL TANK

BACKGROUND OF THE INVENTION

1. Field of the Invention

The present invention relates to an apparatus for correcting an amount of fuel injection of an internal combustion engine. More particularly, it relates to an apparatus for correcting an amount of fuel injection of an internal combustion engine which calculates whether a vapor fuel purged into an intake passage of the internal combustion engine is purged from a canister or a fuel tank, so determines an anticipated correction amount of the amount of fuel injection, and calculates a correction amount of the amount of fuel injection for correcting an air-fuel ratio of the internal combustion engine by this anticipated correction amount.

2. Description of the Related Art

Generally, the internal combustion engine is equipped with an evaporative control system which prevents a fuel vapor (hereinafter referred to as the "vapor") evaporating from a fuel storage portion such as a fuel tank, a carburetor, etc., during the stop of the internal combustion engine, from being emitted to the atmosphere. This evaporative control system lets the vapor evaporating from the fuel storage portion be adsorbed by a canister, and sucks this vapor adsorbed to the canister into the intake side by utilizing an intake negative pressure during the operation of the engine.

When processing for returning (purging) the vapor adsorbed to the canister to the intake side is carried out in such an evaporative control system, a feedback correction amount FAF of the air-fuel ratio changes in accordance with a purge gas concentration. Therefore, a regulation apparatus for regulating this feedback correction amount FAF in accordance with the purge amount must be provided to the evaporative control system.

An example of such a regulation apparatus is described in KOKAI (Japanese Unexamined Patent Publication) No. 62-131962, for example. This prior art apparatus anticipates the feedback correction amount after the change on the basis of fluctuation of the feedback correction amount FAF due to the purge amount before the change when the purge amount of the vapor fuel is changed, and improves response characteristics.

However, the vapor purged into the intake passage of the internal combustion engine includes the vapor which is directly purged from the fuel tank, in addition to the vapor purged from the canister. The amount of the vapor purged from the canister changes in accordance with the adsorption amount and the emission time, while the amount of the vapor purged from the tank changes in accordance with the internal temperature of the tank and fuel properties. Accordingly, the vapor emission characteristics from the canister and the fuel tank with respect to time are not the same. For this reason, when the feedback correction amount FAF is anticipated only from the purge amount supplied from the canister to the intake passage, the anticipated value becomes incorrect, and air-fuel ratio control cannot be precisely carried out.

SUMMARY OF THE INVENTION

An object of the present invention is to provide an apparatus for correcting an amount of fuel injection of an internal combustion engine which estimates and calculates a subsequent purge amount by taking into consideration not only the change of a purge amount of the vapor from the canister side but also the change of a purge amount of the vapor from the fuel tank side, corrects the amount of fuel injection by anticipating coarseness of the air-fuel ratio due to the change of the purge amount, and can thus execute precisely the air-fuel ratio control.

According to one aspect of the present invention, there is provided an apparatus for correcting an amount of fuel injection, disposed in an internal combustion engine an air-fuel ratio of which is controlled by air-fuel ratio feedback control means, which comprises: a canister having a tank port into which a vapor fuel generated in a fuel tank flows through a vapor passage, a purge port for purging the vapor fuel into an intake passage and an atmospheric port communicated with the atmosphere, wherein the tank port and the purge port are communicated through a relay chamber and a trapping material of the vapor fuel is interposed between the relay chamber and the atmospheric port; a control valve disposed at an intermediate part of the purge passage, and capable of adjusting the passage area of the purge passage by changing an opening thereof; tank side correction amount calculation means for calculating a correction amount of the amount of fuel injection for correcting an air-fuel ratio which changes when the vapor fuel generated in the fuel tank is directly supplied to the intake passage through the control valve; canister side correction amount calculation means for calculating a correction amount of the amount of fuel injection which changes when the vapor fuel emitted from the trapping material of the canister is supplied to the intake passage through the control valve; and anticipated correction amount calculation means for inputting an opening signal from the control valve and the correction amounts of the amounts of fuel injection from both of the tank side correction amount calculation means and the canister side correction amount calculation means, and anticipating the correction amount of the amount of fuel injection after opening of the control valve changes, on the basis of the correction amount on the tank side and the correction amount on the canister side, wherein the air-fuel ratio feedback means corrects the amount of fuel injection on the basis of the anticipated correction amount of the amount of fuel injection.

According to the second aspect of the present invention, there is provided the apparatus for correcting the amount of fuel injection of an internal combustion engine described above, wherein the tank side correction amount calculation means includes tank side concentration learning means for determining a proportion of an air-fuel mixture generated in the tank and directly passing through the control valve, learning a tank side vapor concentration and calculating a tank concentration learning value; the canister side correction amount calculation means includes canister side concentration learning means for determining the proportion of an air-fuel mixture once coming off from the canister and passing through the control valve, learning a canister side vapor concentration and calculating a canister concentration learning value; and the anticipated correction amount calculation means anticipates the correction amount on the basis of a tank side learning value and a canister side learning value which are updated by the two learning means, and on the basis of the proportion of the origins of the air-fuel mixtures.

In the apparatus for correcting the amount of fuel injection of an internal combustion engine according to the second aspect described above, the apparatus according to the third embodiment of the present invention further includes tank side vapor concentration rate increasing means for increasing the vapor concentration rate on the tank side by setting the control valve to the closure side for a predetermined period of the operation condition of the internal combustion engine, and wherein the tank side concentration learning means executes the vapor concentration calculation on the tank side on the basis of the anticipated value of the air-fuel mixture from the tank side which is increased by the tank side vapor concentration rate increasing means.

In the apparatus for correcting the amount of fuel injection of an internal combustion engine according to the second aspect described above, the apparatus according to the fourth embodiment of the present invention further includes atmospheric pressure change detection means, and wherein the tank side concentration learning means changes the anticipated value of the 10 proportion of the air-fuel mixture from the tank side in accordance with the change of the atmospheric pressure detected by the atmospheric pressure change detection means.

In the apparatus for correcting the amount of fuel injection of an internal combustion engine according to the fourth embodiment described above, the apparatus according to the fifth embodiment of the present invention further includes tank side vapor concentration rate reduction means for reducing the vapor concentration rate on the tank side by setting the control valve to the open side for a predetermined period after the tank side concentration learning means calculates the tank concentration learning value, and wherein the tank side concentration learning means calculates the canister concentration on the basis of the anticipated value of the proportion of the air-fuel mixture from the tank side reduced by the tank side vapor concentration rate reduction means.

In an apparatus for correcting the amount of fuel injection of an internal combustion engine according to the second aspect described above, the apparatus according to the sixth embodiment of the present invention further includes limit purge amount setting means for setting a maximum vapor fuel amount introduceable into the intake system in accordance with the operation condition of the internal combustion engine, and control valve driving means for driving the control valve in accordance with the set value, the anticipated value of the proportion of the air-fuel mixture from the tank side, the tank concentration learning value and the canister concentration learning value.

In the apparatus for correcting the amount of fuel injection of an internal combustion engine according to the first aspect described above, the apparatus according to the seventh embodiment further includes control valve closure time detection means for detecting the duration time of the fully closed state of the control valve during the operation of the engine; purge re-execution detection means for detecting re-start of execution of purge after the fully closed state lasts for a predetermined time; and control valve purge re-start opening control means for setting the opening of the control valve to the closure side in accordance with the vapor concentration on the tank side for a predetermined period at the re-start of execution of the purge.

In this way, the apparatus for correcting the amount of fuel injection of an internal combustion engine according to the present invention takes not only the change of the purge amount of the vapor from the canister side but also the change of the purge amount of the vapor from the fuel tank side into consideration, estimates the subsequent purge amount, anticipates coarseness of the air-fuel ratio in accordance with the change of the purge amount and corrects the fuel injection amount. Therefore, it can correctly execute the air fuel ratio control and can improve response characteristics.

BRIEF DESCRIPTION OF THE DRAWINGS

The present invention will be more clearly understood from the description as set forth below with reference to the accompanying drawings, in which:

FIG. 26 is a flowchart showing the control example of the ninth embodiment of the present invention, and showing a modified example of the fixed purge flow control of the eighth embodiment explained with reference to FIG. 24;

FIG. 27A is a diagram showing the change of the vapor concentration updated value with respect to time in the procedure of the ninth embodiment shown in FIG. 26;

FIG. 27B is a diagram showing the change of the purge amount;

FIG. 27C is a diagram showing the change of the car speed;

DESCRIPTION OF THE PREFERRED EMBODIMENTS

Figure 1A:
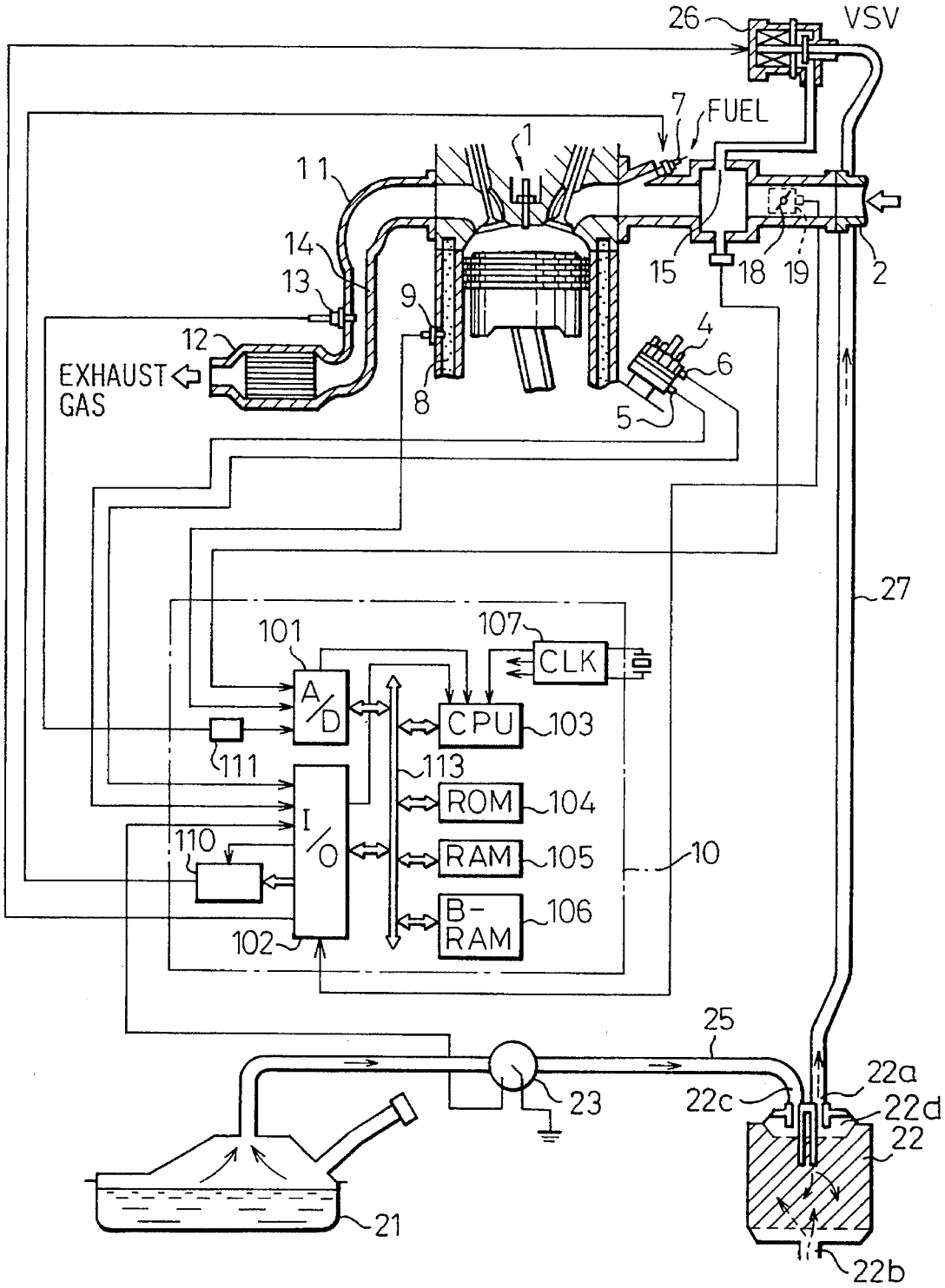
FIG. 1A is a structural view showing the construction of an electronic fuel injection type internal combustion engine equipped with a fuel injection amount correction apparatus according to the present invention.

FIG. 1A schematically shows an electronic control fuel injection type internal combustion engine equipped with a fuel injection amount correction apparatus according to the present invention. In the drawing, a throttle valve 18 is shown disposed downstream of an air flow meter (not shown) for measuring an air flow amount, in an intake passage 2 of the internal combustion engine 1. A throttle opening sensor 19 for detecting the opening of the throttle valve 18 is fitted to a shaft of the throttle valve 18. A fuel injection valve 7 for supplying a pressurized fuel from a fuel supply system to an intake port is disposed for each cylinder in the intake passage 2 downstream of the throttle opening sensor 19.

A distributor 4 is provided with a crank angle sensor 5 which generates a pulse signal for detecting a reference position at each 720° CA, when the axis thereof is converted to a crank angle (CA), and a crank angle sensor 6 which generates a pulse signal for detecting the reference position at each 30° CA. These crank angle sensors 5 and 6 function as an interrupt request signal of a fuel injection timing, a reference timing signal of an ignition timing, an interrupt request signal of fuel injection amount calculation control, and so forth. These signals are supplied to an input-output interface 102 of a control circuit 10, and among them, the output of the crank angle sensor 6 is supplied to an interrupt terminal of a CPU 103.

A water temperature sensor 9 for detecting the temperature of cooling water is disposed in a cooling water passage 8 of a cylinder block of the internal combustion engine. This water temperature sensor 9 generates an electric signal of an analog voltage corresponding to the temperature THW of the water temperature sensor 9. This output, too, is supplied to an A/D convertor 101.

A ternary catalyst convertor 12 for simultaneously purifying three determental components in an exhaust gas, that is, HC, CO and NOx, is disposed in an exhaust system downstream of an exhaust manifold 11. An $O_2$ sensor 13 as a kind of an air-fuel ratio sensor is disposed in the exhaust pipe 14 downstream of the exhaust manifold 11 but upstream of the catalyst convertor 12. The $O_2$ sensor 13 generates an electric signal in accordance with the oxygen concentration in the exhaust gas. In other words, the $O_2$ sensor 13 supplies different output voltage depending on whether the air-fuel ratio exists on the rich side or the lean side with respect to a stoichiometric air-fuel ratio, to the A/D convertor 101 through a signal processing circuit 111 of the control circuit 10. ON/OFF signals of a key switch, not shown, are supplied to the input/output interface 102.

An evaporator control system for preventing a vapor evaporating from a fuel tank 21 from escaping into the atmosphere is disposed in the internal combustion engine 1. This system includes a charcoal canister (hereinafter called merely the "canister") 22 and an electrical purge flow control valve (D-VSV) 26. Three openings 22*a*, 22*b* and 22*c* are provided to the canister 22. The openings 22*a* and 22*c* are connected via an inside space 22*d* of the canister 22. The opening 22*c* of the canister 22 is connected to the upper bottom of the fuel tank 21 through a vapor collecting pipe 25 and traps the vapor evaporating from the fuel tank 21. The opening 22*b* of the canister 22 is open to the atmosphere, and the opening 22*c* is connected to a purge port 15 of the intake passage 2 by a purge pipe 27.

A tank internal pressure control valve 23 which opens when the vapor pressure inside the fuel tank 21 exceeds a predetermined pressure is disposed at an intermediate portion of the vapor collecting pipe 25. A switch is fitted to this internal pressure control valve 23, and the ON/OFF state of the internal pressure control valve 23 is inputted to the input/output interface 102. D-VSV 26 is a solenoid valve disposed at an intermediate part of the purge pipe 27 for purging the vapor trapped by the canister 22 to the downstream side of the throttle valve 18. D-VSV 26 is opened and closed by receiving the electric signals from the control circuit 10, and can effect duty control of the vapor amount which is allowed to flow into the intake passage 2.

In the construction described above, when the key switch, not shown, is turned ON, power is applied to the control circuit 10, and a program activates, inputs the output from each sensor, and controls an injector 7 and other actuators.

The control circuit 10 is constituted by using a microcomputer, for example. Besides the A/D convertor 101, the input/output interface 102 and the CPU 103 described above, the control circuit 10 includes a ROM 104, a RAM 105, a backup RAM 106 for holding data even after the key switch is turned OFF, a clock (CLK) 107, etc., and these members are connected by a bus 113.

In the control circuit 10, an injection control circuit 110 including a down counter, a flip-flop and a driving circuit, is to control the fuel injection valve 7. In other words, when a fuel injection amount TAU obtained by correcting a basic injection amount $T_p$ calculated from the intake air amount and the engine speed by the operating condition of the engine is calculated, the fuel injection amount is preset to the down counter of the fuel injection control circuit 110 and the flip-flop, too, is set, so that the driving circuit starts activating the fuel injection valve 7. On the other hand, when the down counter counts the clock signals (not shown) and finally, its carryout terminal reaches a "1" level, the flip-flop is reset and the driving circuit stops activation of the fuel injection valve 7. In other words, the fuel injection valve 7 is activated by the fuel injection amount TAU described above. Consequently, the fuel in the amount corresponding to the fuel injection amount TAU is sent into the combustion chamber of the internal combustion engine 1.

By the way, the CPU 103 generates the interrupt after A/D conversion is completed by the A/D convertor 101, when the input/output interface 102 receives the pulse signal of the crank angle sensor 6, when it receives the interrupt signal from the clock generation circuit 107, and so forth.

In the fuel injection amount correction apparatus having the construction described above, the control circuit 10 judges whether the vapor purged to the intake passage 2 is emitted from the canister 22 side or from the fuel tank 21, and controls the air-fuel ratio by correcting the fuel injection amount.

Before describing the preferred embodiments of the present invention for correcting the amount of fuel injection in accordance with the amount of the fuel-vapor purged from the canister and the fuel tank, the explanation will be given on the conventional method of correcting the amount of fuel injection in accordance with the amount of the fuel-vapor purged form the canister with reference to FIGS. 2 to 7B.

Figure 2:
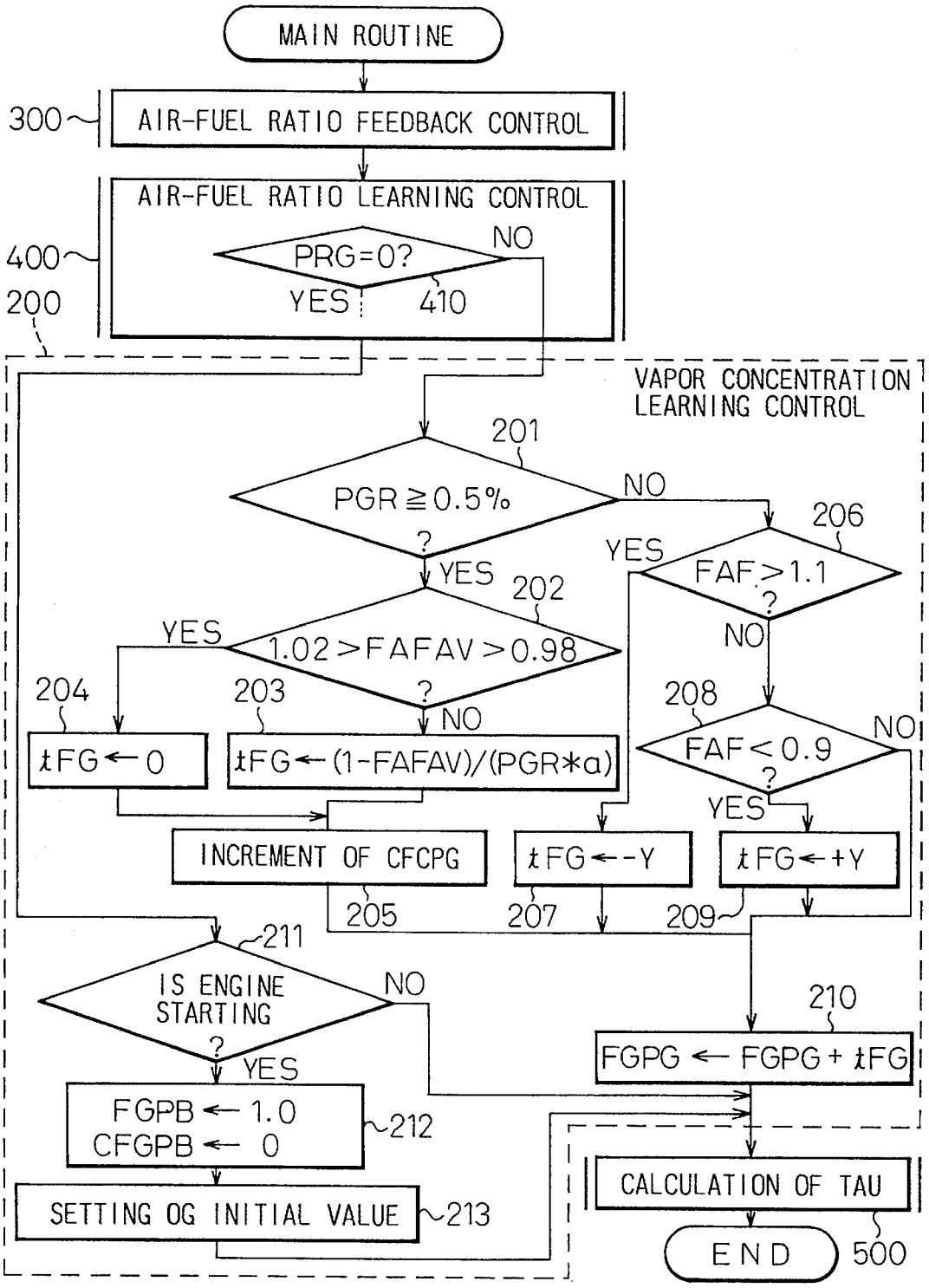
Fig.2 PRIOR ART
FIG. 2 is a flowchart showing a basic control procedure of air-fuel ratio control of a controller for an internal combustion engine equipped with the fuel injection amount correction apparatus shown in FIG. 1A.

FIG. 2 shows the main routine of the conventional air-fuel ratio control by the controller 10 of the internal combustion engine equipped with the fuel injection amount correction apparatus shown in FIG. 1A. The controller 10 executes the feedback control of the air-fuel ratio at step 300, and executes learning control of the air-fuel ratio at the subsequence step 400. whether or not purging is carried out in this learning control step of the air-fuel ratio is judged from whether or not a flag PGR is 0. When PGR is 0, the learning control of the air-fuel ratio is executed as such, and the flow then proceeds to step 200, where vapor concentration learning control is executed. When PGR≠0, the flow proceeds to step 201 in the vapor concentration learning control which is executed at step 200 after step 300. The vapor concentration learning control shown in FIG. 2 constitutes the basis for practicing the present invention, as well be described in detail later, and learning of the vapor concentration is made without discriminating whether the vapor is from the canister or from the fuel tank. The embodiments of the present invention are accomplished by modifying a part of the vapor concentration learning control shown in this FIG. 2. After the vapor concentration learning control at this step 200 is completed, the flow proceeds to step 500, where the fuel injection amount TAU is calculated.

Figure 3:
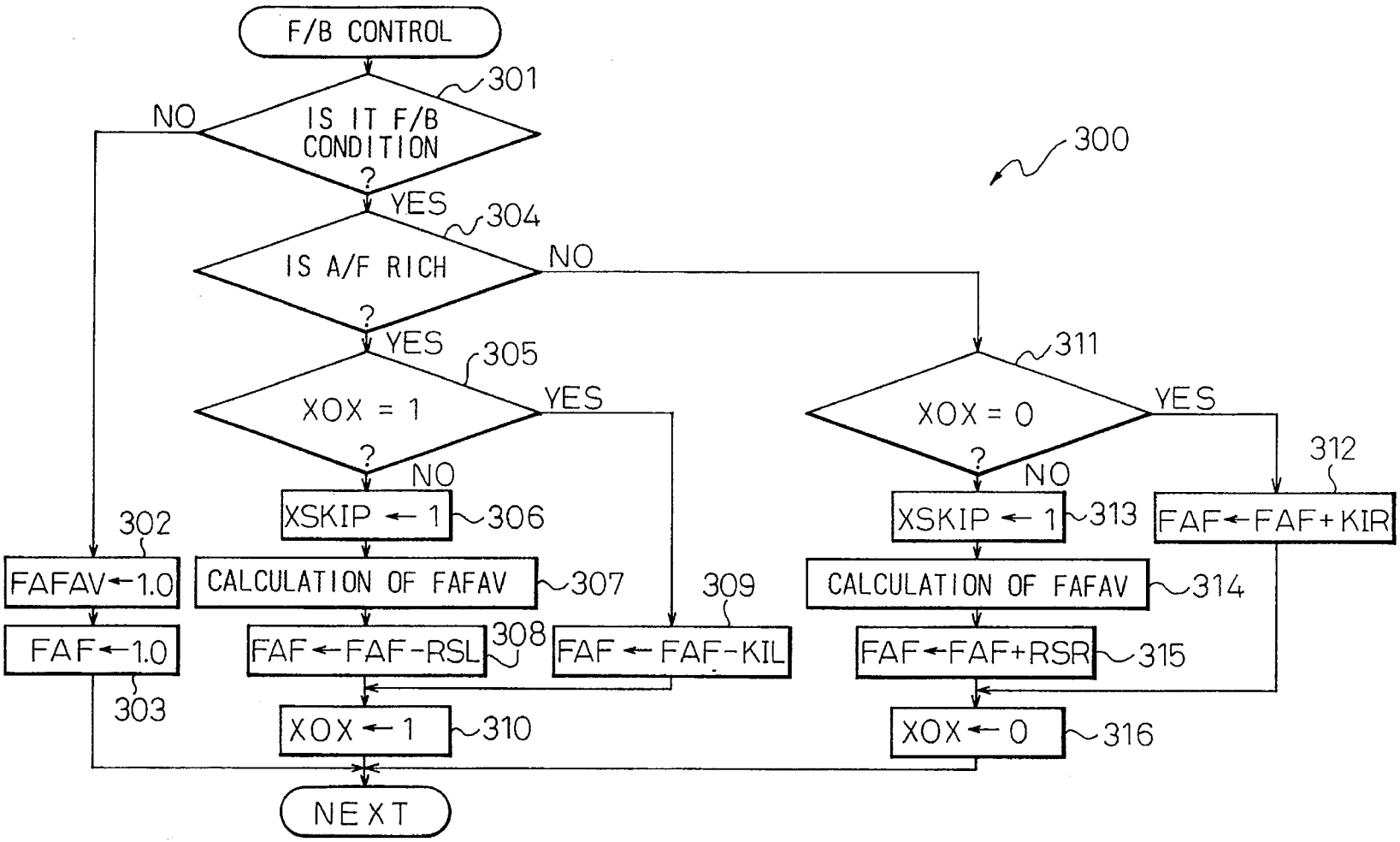
Fig.3 PRIOR ART
FIG. 3 is a flowchart showing the detail of air-fuel ratio feedback control at step 300 of FIG. 2.

FIG. 3 shows the detail of the air-fuel ratio feedback control at step 300. In this air-fuel ratio feedback control, it is determined at first whether or not a feedback (F/B) condition is satisfied at step 301. This F/B condition is satisfied when all of the following conditions are satisfied:

(1) the timing is not the start of the engine;

(2) the fuel is not cut;

(3) the water temperature is not lower than 40° C.; and (4) activation of the air-fuel sensor is finished.

When the F/B condition is not judged as satisfied at step 301, the flow proceeds to step 302 and the mean value FAFAV of the air-fuel ratio feedback correction amount is set to a reference value 1.0. At the subsequent step 303, the air-fuel ratio feedback correction amount FAF is set to the reference value 1.0 and the this routine is completed.

On the other hand, when the F/B conditions are all judged as satisfied at step 301, the flow proceeds to step 304, and whether the air-fuel ratio (A/F) is rich or not is judged. When the air-fuel ratio is judged as rich, the flow proceeds to step 305, and whether or not the air-fuel ratio was rich the last time, too, is judged from whether a flag XOX is "1" (rich the last time) or "0" (lean the last time). When the air-fuel ratio was lean the last time but changes to rich this time, the flow proceeds to step 306, and a skip flag XSKIP is set to 1 (XSKIP←1). At the subsequent step 307, a mean value FAFAV is calculated between the air-fuel ratio feedback correction amount FAF of the last time and the air-fuel ratio feedback correction amount FAF of this time. Further, the air-fuel ratio feedback correction amount FA is skipped and reduced by a predetermined skip value −RSL at step 308. When the air-fuel ratio is judged as rich the last time, too, at step 305, the flow proceeds to step 309, and the air-fuel ratio feedback correction amount FAF is integrated and reduced by a predetermined integration value −KIL. After steps 308 and 309 are completed, the rich flag XOX representing that the air-fuel ratio was rich the last time is set to "1" and this routine is completed.

Further, when the air-fuel ratio is judged as lean at step 304, the flow proceeds to step 311 and whether or not the air-fuel ratio was lean the last time, too, is judged from whether the flag XOX is 0 (lean, the last time, too) or 1 (rich the last time). When the air-fuel ratio was rich the last time and changes to lean this time, the flow proceeds to step 312, and the skip flag XSKIP is set to 1 (XSKIP←1). At the subsequent step 314, the mean value FAFAV is calculated between the previous air-fuel ratio feedback correction amount FAF and the air-fuel ratio feedback amount FAF of this time. Furthermore, the air-fuel ratio feedback correction amount FAF is skipped and increased by a predetermined skip value. When the air-fuel ratio is judged as lean the last time, too, at step 311, the flow proceeds to step 312, and the air-fuel ratio feedback correction amount FAF is integrated and increased by a predetermined integration value +KIP. After steps 312 and 315 are completed, the rich flag XOX representing that the air-fuel ratio was lean the last time is set to 1 at step 316, and this routine is completed.

Figure 4:
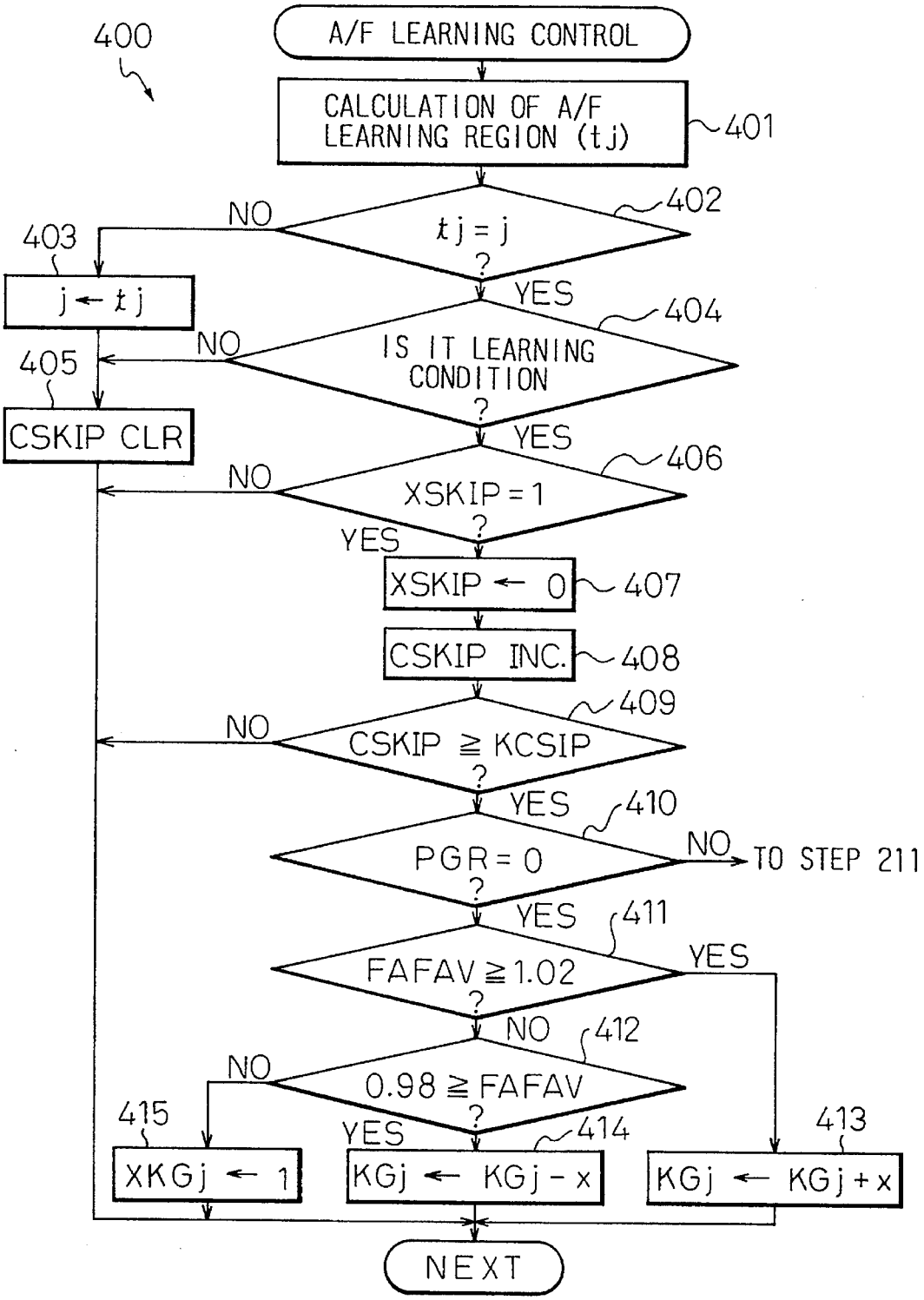
Fig. 4 PRIOR ART
FIG. 4 is a flowchart showing the detail of air-fuel ratio learning control at step 400 of FIG. 2.

After the air-fuel ratio feedback control at step 200 is thus completed, the flow proceeds to step 400 and the air-fuel ratio learning control is executed. This air-fuel ratio learning control is shown in FIG. 4.

At step 401, an air-fuel ratio learning region tj is calculated. This air-fuel ratio learning region tj determines which of the air-fuel ratio learning regions which are divided into KG1 to KG7 in terms of the intake pipe pressure, for example, the present region is. At the subsequent step 402, whether the number j of the air-fuel ratio learning region obtained the last time is the same as the number of the air-fuel ratio learning region tj calculated this time is equal or not. When the air-fuel ratio learning region tj is judged as different at step 402, the flow proceeds to step 403, and the air-fuel ratio learning region tj of this time is stored as the air-fuel ratio learning region j of the last time, and at the subsequent step 405, the skip number CSKIP is cleared and this routine is completed.

On the other hand, when the air-fuel ratio learning region tj calculated this time is judged as equal at step 402, the flow proceeds to step 404 and whether or not the air-fuel ratio learning condition is established is judged. This air-fuel ratio learning condition is established when all of the following conditions are satisfied:

(1) air-fuel ratio feedback is being made;

(2) there is no increase in the air-fuel ratio feedback correction amount; and (3) the water temperature is not lower than 80° C. When the air-fuel ratio learning condition is not satisfied at step 404, the flow proceeds to step 405. The skip number CSKIP is cleared and this routine is completed. When the air-fuel ratio learning condition is satisfied, the flow proceeds to step 406.

At step 406, whether or not the skip flag XSKIP is 1 is judged. When XSKIP=0, this routine is completed. When XSKIP=1, the skip flag XSKIP is set to 0 at step 407, and the skip number SKIP is incremented (increased) at step 408. At the subsequent step 409, whether or not this skip number XSKIP is greater than a predetermined number, for example 3, is judged, and the routine is completed when CSKIP<KCSKIP. When CSKIP≧KCSKIP, the flow proceeds to step 410. When the flow proceeds to step 410, it means that the feedback control is being made in the same air-fuel ratio learning region. Therefore, whether or not the purge ratio PGR is 0 is judged.

When the purge ratio is not 0 at step 410, the flow proceeds to step 211 shown in FIG. 2, and when the purge ratio is 0, the flow proceeds to step 411, and whether or not the mean value FAFAV of the air-fuel ratio feedback correction amount is greater than a predetermined value (1.02, in this embodiment) is judged. At the subsequent step 412, whether or not the mean value FAFAV of the air-fuel ratio feedback correction amount is a predetermined value (0.98, in this embodiment) is judged. In other words, steps 411 and 412 of this embodiment judge whether or not the mean value FAFAV of the air-fuel ratio feedback correction amount deviates by at least 2%. When the mean value FAFAV of the air-fuel ratio feedback correction amount is found greater by at least 2% at step 411, the flow proceeds to step 413 and the learning value KGj in this learning region is increased by a predetermined value x. When the mean value FAFAV of the air-fuel ratio feedback amount is found smaller by at least 2% at step 412, the flow proceeds to step 414, and the learning value KGj in this learning region is decreased by the predetermined value x. When steps 411 and 412 judge that the mean value FAFAV of the air-fuel ratio feedback correction amount is less than±2%, the flow proceeds to step 415. Here, the air-fuel ratio learning completion flag XKGj in this learning region is set to 1 and this air-fuel ratio learning control routine is completed.

When the air-fuel ratio learning control at step 400 is thus completed, the flow proceeds to step 200 and the vapor concentration learning control is executed. This vapor concentration learning control is shown in FIG. 2.

When the purge ratio PGR is judged as not being 0 at step 410 in FIG. 4, the flow proceeds to step 201 of FIG. 2, and whether or not the purge ratio PGR is greater than a predetermined value (0.5%, in this embodiment) is judged. When PGR≧0.5% is judged at step 201, the flow proceeds to step 202, and whether or not the mean value FAFAV of the air-fuel ratio feedback correction amount is within±2% is judged. When 0.98<FAFAV<1.02, the flow proceeds to step 204, the vapor concentration updating value tFG is set to 0 and the flow proceeds to step 205. When FAFAV≦0.98 or FAFAV≧1.02, the flow proceeds to step 203, and a vapor concentration updating value tFG per purge ratio is determined in accordance with the following formula:

$$tFG \leftarrow (1-FAFAV)/(PGR \times a)$$

The flow then proceeds to step 205, and the vapor concentration updating number CFGPG is updated and the flow proceeds to step 210.

When the purge ratio PGR is judged as being less than 0.5% at step 201, the vapor concentration updating accuracy is low. Therefore, the flow proceeds to steps 206 et seq, and whether or not the deviation of the air-fuel ratio feedback correction amount is great is judged. In this embodiment, the deviation of the air-fuel ratio feedback correction amount FAF is set to be within±10%. At step 206, whether or not the air-fuel ratio feedback correction amount FAF is greater than 1.1 is judged and at the subsequent step 207, whether or not the air-fuel ratio feedback correction amount FAF is smaller than 0.9 is judged. When FAF>1.1, the flow proceeds from step 206 to step 207, and after the vapor concentration updating value tFG is decreased by a predetermined value Y, the flow proceeds to step 210. When FAF<0.9, the flow proceeds from step 206 to step 209 through step 208, and the vapor concentration updating value tFG is increased by the predetermined value Y. The flow then proceeds to step 210. Further, when 0.9≦FAF≦1.1, judgement proves NO at both steps 206 and 208, and the flow proceeds as such to step 210.

At step 210, the vapor concentration updating value tFG is added to the vapor concentration FGPG so as to update the vapor concentration, and the flow proceeds to the calculation routine 500 of the next fuel injection amount TAU.

When purge is not carried out in the air-fuel ratio learning control at step 400 and the purge ratio is 0, the flow proceeds, from step 400 to step 211. At step 211, whether or not the engine is starting is judged, and when the engine is not staring, the flow proceeds as such to step 500. When the engine is starting, the flow proceeds to step 212. At this step 212, the vapor concentration FGPG is set to the reference value 1.0, the vapor concentration updating number CFPG is cleared, and the flow then proceeds to step 213. At step 213, initial values are set to other variables and the flow proceeds to the next step 500.

Figure 5:
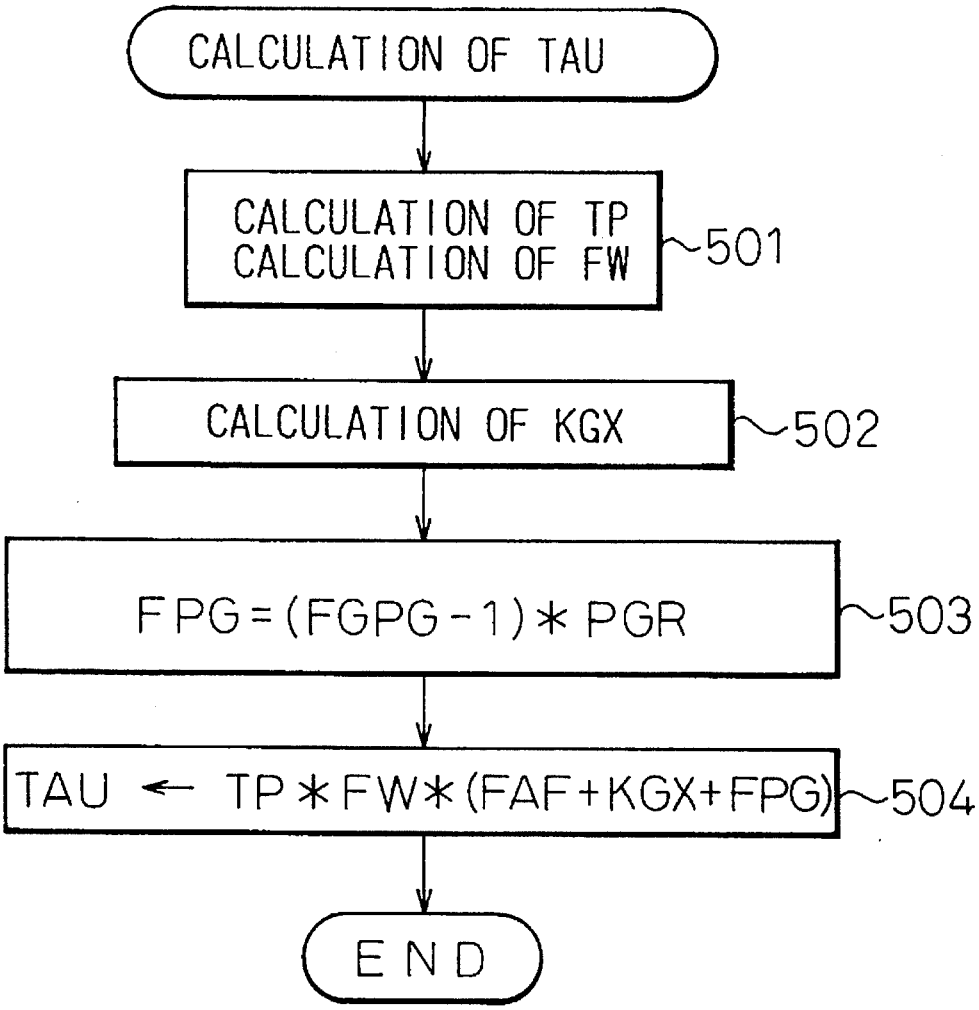
Fig. 5 PRIOR ART
FIG. 5 is a flowchart showing the detail of calculation of the fuel injection amount at step 500 of FIG. 2.

The detail of the calculation processing of the fuel injection amount at step 500 is shown in FIG. 5. At first, at step 501, the basic fuel injection amount TP and each of various correction values FW are calculation on the basis of the engine speed and the engine load among the data stored. At the subsequent step 502, the air-fuel ratio learning value KGX at the present intake pipe pressure is determined from the air-fuel ratio learning value KGj of the adjacent learning region. Further, at the next step 503, the purge air-fuel ratio correction amount FPG is calculated in accordance with the following formula:

$$FPG=(FGPG-1)\times PGR$$

Finally, at step 504, the fuel injection amount TAU is calculated in accordance with the following formula and the main routine is completed:

$$TAU \leftarrow TP \times FW \times (FAF+KGX+FPG)$$

Figure 6:
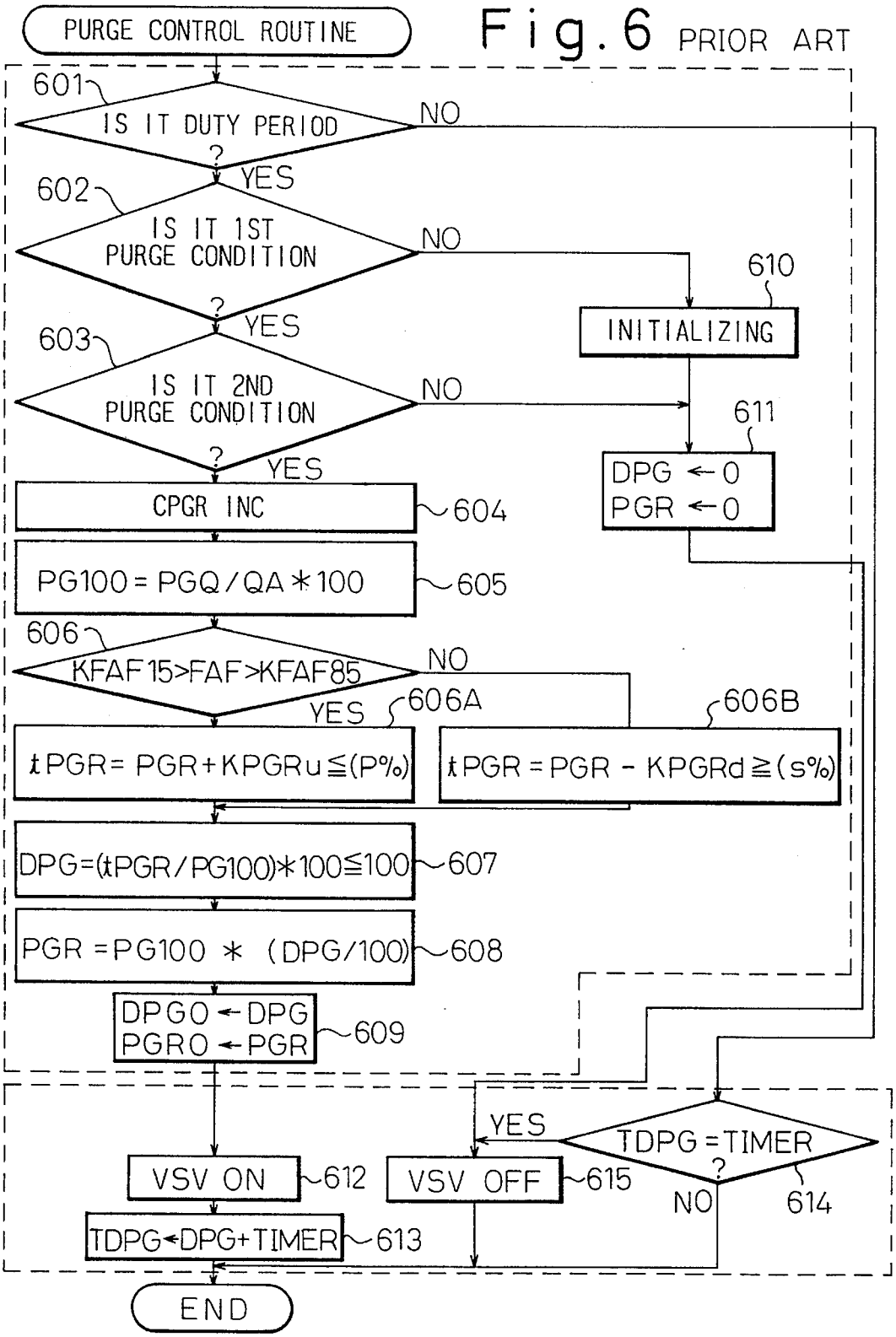
Fig. 6 PRIOR ART
FIG. 6 is a flowchart showing the control procedure of purge control of a controller of an internal combustion engine equipped with the fuel injection amount correction apparatus shown in FIG. 1A.

Next, the conventional purge control in the fuel injection amount correction apparatus shown in FIG. 1A and the driving processing of D-VSV 26, which is disposed at an intermediate portion of the purge pipe 27 and is subjected to duty control, will be explained with reference to FIG. 6.

First, whether or not the period is the duty period is judged at step 601. Generally, this duty deriod is approximately 100 ms. When the period is judged as being not the duty period at step 601, the flow proceeds to step 614, and whether or not the time is the feed completion time TDPG of the D-VSV 26 is judged from TDPG=TIMER, and when TDPG≠TIMER, this routine is as such completed. When TDPG=TIMER, on the other hand, the flow proceeds to step 615 and the feed of power to the D-VSV 26 is stopped and the D-VSV 26 is turned OFF.

When the period is judged as the duty period at step 601, on the other hand, the flow proceeds to step 602, and whether or not the first purge condition is satisfied is judged. The first purge judgement condition is establishment of the air-fuel ratio learning condition other hand fuel cut. When the condition is not the first purge judgement condition, the flow proceeds to step 610, and after initialization of the associated RAM is effected, the duty value DPG and the purge ratio PGR are cleared at step 611. The flow then proceeds to step 615, and the D-VSV 26 is turned OFF (valve opening).

When the condition is the first purge judgement condition at step 602, the flow proceeds to step 603 and whether or not the condition is the second purge judgement condition is judged. The second purge judgement condition corresponds to the case where the fuel is not cut and the air-fuel ratio learning completion flag XKJi=1 in the learning completion region is satisfied. When the condition is not the second purge judgement condition, the flow proceeds to step 611 and the duty value DPG and the purge ratio PGR are cleared. The flow then proceeds to step 615 and the D-VSV 26 is turned OFF. When the condition is the second purge judgement condition, the flow proceeds to step 604 and a purge execution timer CPGR is incremented. At the subsequent step 605, the purge ratio PG100 when the D-VSV 26 is fully opened is calculated in accordance with the following formula from the intake air amount QA ratio of the purge flow amount (see FIG. 7A) when the D-VSV 26 is fully open:

$$PG100=PGQ/QA\times 100$$

At the next step 606, whether or not the air-fuel ratio feedback amount FAF exists within a predetermined range (KFA85<FAF<KFAF15) is judged, and when KFAF85<FAF< KFAF15, the target purge ratio tPGR is increased in accordance with the following formula at step 606A:

$$tPGR=PGR+KPGRu$$

Figure 7A:
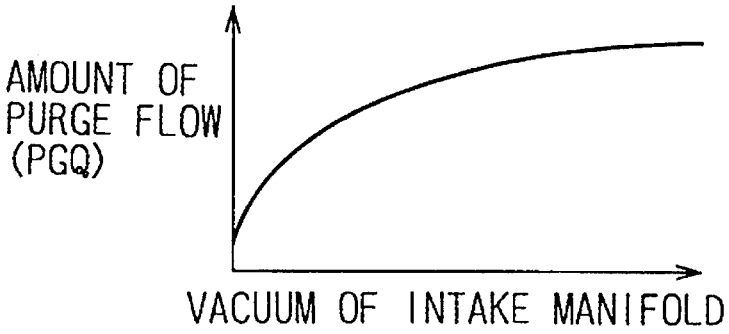
Fig. 7A PRIOR ART
FIG. 7A is a diagram showing purge flow characteristics with respect to vacuum of an intake manifold.
Figure 7B:
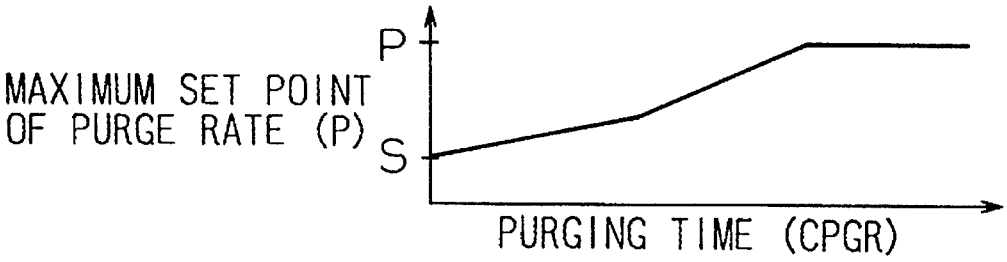
Fig. 7B PRIOR ART
FIG. 7B is a diagram showing the relation between a maximum set point of a purge rate and a purging time.

However, the maximum value of tPGR is limited to P% shown in FIG. 7B. When the air-fuel ratio feedback amount FAF does not exist within the predetermined range, the flow proceeds to step 606B, and the target purge ratio tPGR is decreased in accordance with the following formula:

$$tPGR=PGR-KPGRd$$

However, the minimum value of tPGR is limited to S% shown in FIG. 7B. The target purge ratio tPGR is limited between S% and P% in order to prevent coarseness of the air-fuel ratio due to purging.

Next, at step 607, the value of the duty value DPG as the time for opening the D-VSV 26 is calculated in accordance with the following formula:

$$DPG=(tPGR/PG100)\times 100$$

However, the maximum value of this duty value DPG is 100%. Next, the purge ratio PGR is calculated at step 608 in accordance with the following formula:

$$PGR=PG100\times(DPG/100)$$

Therefore, the duty value DPG is stored as the previous value DPG0 at step 609, and the purge ratio PGR is stored as the previous purge ratio PGR0.

After the purge control is completed in this way, the flow proceeds to step 612, and power is fed to the D-VSV 26 to turn it ON. At the subsequent step 613, the feed completion time TDPG of the D-VSV 26 is calculated, and this routine is completed.

Figure 1B:
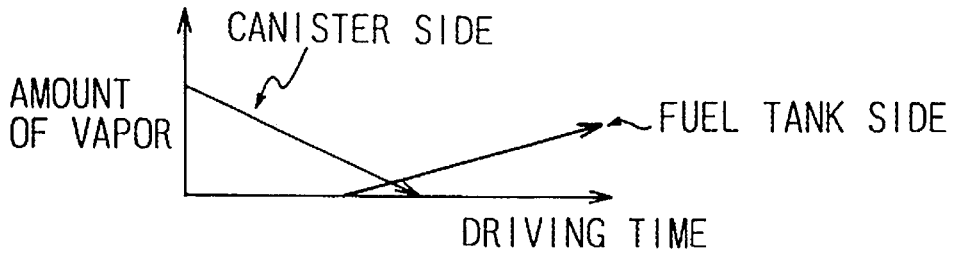
FIG. 1B is a diagram showing the change of a vapor amount from a canister and a vapor amount from a fuel tank with respect to the driving time of a vehicle.

Incidentally, the vapor purged from the canister decreases in proportion to the purge time in accordance with the vapor trapping amount to the canister and the emission time, whereas the vapor emitted from the fuel tank tends to increase with the operation time of the engine (driving time). In other words, it has been found out that the vapor of the canister decreases by purging but the vapor from the fuel tank tends to increase due to external heat, etc., when the vehicle drives. This tendency is shown in FIG. 1B.

Figure 1C:
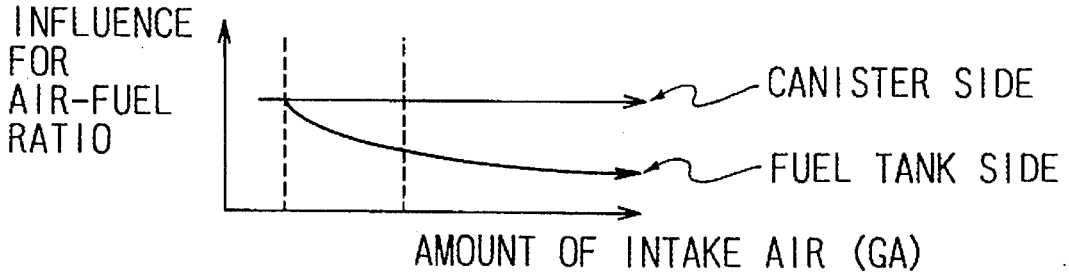
FIG. 1C is a diagram showing the influences of the vapor amount from the canister on an intake air amount and the vapor amount from the fuel tank on an air-fuel ratio.

In conjunction with the influences of the vapors from the canister side and the tank side on the air-fuel ratio, it has been found out that the influence on the air-fuel ratio can be made constant on the canister side in proportion to the intake air amount, and the vapor on the tank side is instantaneously substantially constant and if the internal temperature of the tank and the fuel properties are constant, the vapor amount is constant irrespective of the intake air amount GA. This tendency is shown in FIG. 1C.

The present invention is completed on the basis of these recognitions.

Figure 8:
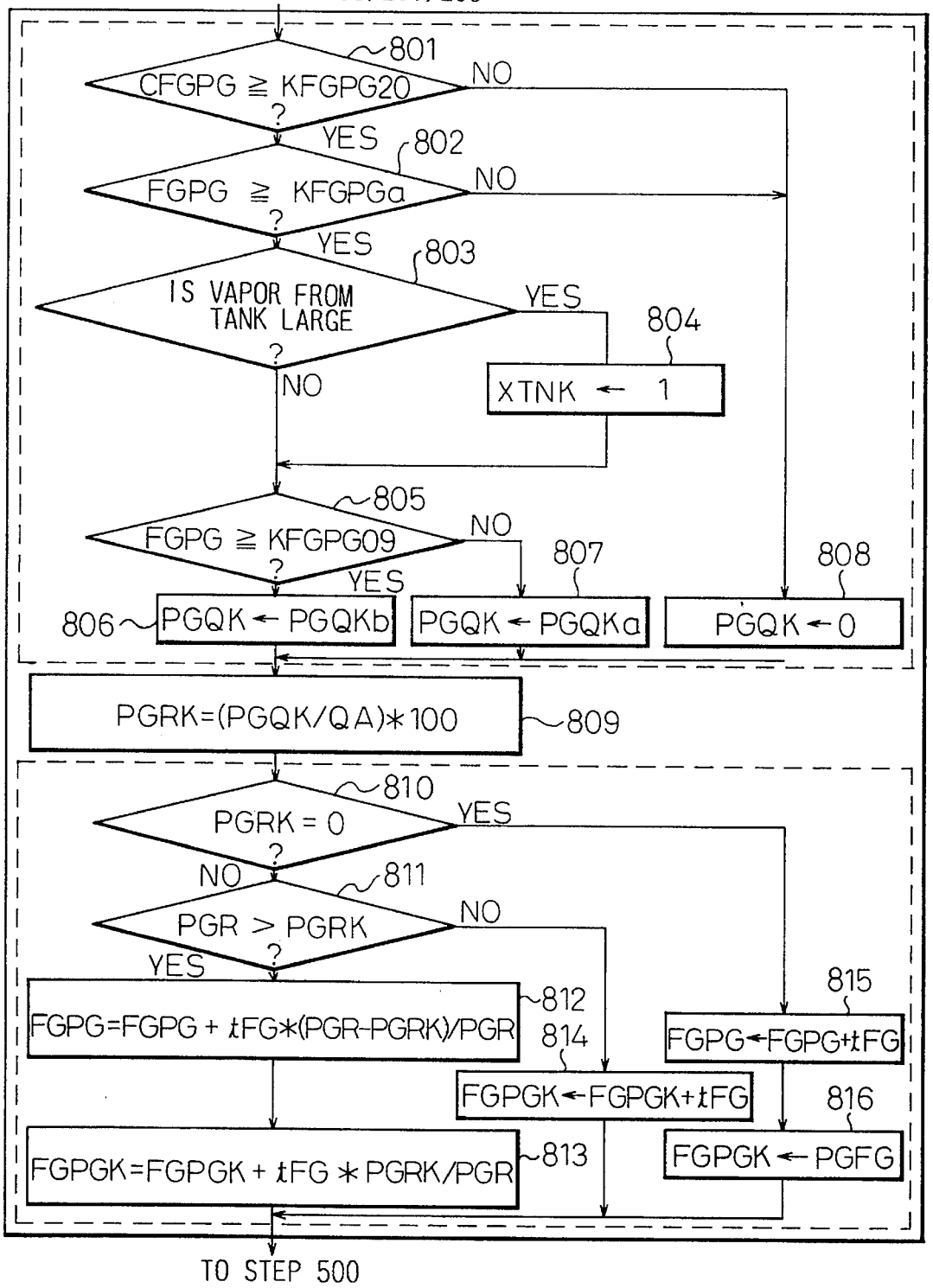
FIG. 8 is a flowchart showing the control of the first embodiment of the present invention, and showing in detail the content of step 210 in purge concentration learning control explained with reference to FIG. 2.

FIG. 8 shows the control of the first embodiment of the present invention. This control changes the content to the content of step 210 in the purge concentration learning control step 200 explained with reference to FIG. 2. At step 210, the vapor concentration FGPG is updated by adding the vapor concentration updating value tFG to the vapor concentration FGPG but in the first embodiment of the present invention, setting control of the fixed purge flow amount from the fuel tank side is first carried out from step 801 to step 808 and then the updating control of the vapor concentration is executed from the subsequent steps 810 to 816.

In the setting control of the fixed purge flow amount from the fuel tank side, whether or not the vapor concentration intake number CFGPG is greater than a predetermined number KFGP20 is judged at step 801. The flow proceeds to step 802 when CFGPG≧KFGPG20 and to step 808 when CFGPG<KFGPG20. At step 802, whether or not the vapor concentration FGPG from the canister side is greater than the predetermined value KFGPGa is judged, and the flow proceeds to step 803 when FGPG≧KFGPGa and to step 808 when FGPG<KFGPGa. At step 803, whether or not the vapor on the tank side is greater is judged, and when the vapor on the tank side is greater, the flag XTNK representing the condition where the fuel tank generates a large amount of vapor is set to 1. The vapor on the tank side is judged to be great when an air-fuel ratio is changed to rich side in an idle-state of the engine.

When the vapor on the tank side is judged as being not greater at step 803, the flow proceeds to step 805, and whether or not the vapor concentration FGPG on the canister side is greater than the predetermined value KFPG09 is judged. When the vapor concentration is high at which FGPG≧KFGPG09, the flow proceeds to step 806 and the fixed purge flow amount PGQK is set to the set value PGQKb. When the vapor concentration FGPG is low at which FGPG<KFGPG09, the flow proceeds to step 807 and the fixed purge flow amount PGQK is set to the set value PGQKa (<PGQKb). On the other hand, at step 808 to which the flow proceeds when CFGPG<KFGPG20 at step 801 or when FGPG<KFGPGa at step 802, the fixed purge flow amount is set to 0.

At the subsequent step 809, the fixed flow amount purge ratio PGRK is calculated in accordance with the following formula:

$$PGRK\leftarrow(PGQK/QA)\times 100$$

After the fixed flow amount purge ratio PGRK is calculated at step 809, the control shifts to the vapor concentration updating control. In this vapor concentration updating control, whether or not the purge ratio PGRK of the fixed flow is 0 is first judged at step 810, and the flow proceeds to step 815 when PGRK=0. Next, at step 815, the vapor concentration updating value tPG is added to the vapor concentration FGPG on the canister side. This sum value is used as the new vapor concentration FGPG on the canister side. At the subsequent step 816, the vapor concentration FGPG on the canister side is stored as the vapor concentration FGPGK on the tank side, and then the flow proceeds to the calculation processing step 500 of the fuel injection amount TAU.

It is when the condition for separating the fixed flow amount from the flow amount from the canister is not satisfied that the flow proceeds from step 810 to step 815. This is the time when the amount of vapor concentration learning is small or when the vapor concentration is extremely high. When the vapor concentration is high, release of the vapor from the canister is extremely fast and the concentration change is fast, too. If the origin of the vapor is divided into the tank side and the canister side and the vapor is expressed by their proportion, one of them cannot be updated and learning accuracy gets deteriorated, on the contrary. Therefore, in such a case, the fixed flow amount purge ratio PGRK is set to 0. When the fixed flow amount purge ratio PGRK is set to 0, only the vapor concentration on the canister side is updated.

When PGRK≠0 is judged at step 810, on the other hand, the flow proceeds to step 811, and whether or not the purge ratio PGR is greater than the fixed flow amount purge ratio PGRK is judged. When PGR≦PGRK, the flow proceeds to step 814, and the vapor concentration updating value tFG is added to the vapor concentration FGPGK on the tank side so as to update the vapor concentration PGPGK on the tank side. The flow then proceeds to step 500.

When the result of judgment proves PGR>PGRK at step 811, the flow proceeds to step 812 and the vapor concentration FGPG on the canister side (fluctuation side) is updated in accordance with the following formula:

$$FGPG=FGPG+tFG\times(PGR-PGRK)/PGR$$

At the subsequent step 813, the vapor concentration FGPGK on the tank side (fixed side) is updated in accordance with the following formula, and the flow proceeds to step 500:

$$FGPGK=FGPGK+tFG\times PGRK/PGR$$

As described above, when the purge ratio on the canister side is smaller than the purge ratio on the tank side, only the concentration on the tank side is taken in. When the flow amount on the tank side is smaller than the actual purge ratio, only the concentration on the tank side is updated at step 814. Further, the purge flow amount is greater than the flow amount on the tank side, the purge ratio on the canister side with respect to the total purge ratio, that is, the value obtained by subtracting the purge ratio on the fixed side from the purge ratio, becomes hereby the purge ratio on the canister side. Accordingly, the value obtained by dividing the deviation from 1±0.02 as the mean value of the air-fuel ratio feedback correction amount by the purge ratio is obtained as the vapor concentration updating value tFG at step 203 explained with reference to FIG. 2, and this vapor concentration updating value tFG is used for the vapor concentration updating control. As a result, the purge ratios on the canister side and the tank side are updated at a predetermined ratio.

As described above, the vapor concentrations in the first embodiment are two, that is, the vapor concentration FGPG on the canister side and the vapor concentration FGPGK on the tank side. Therefore, the correction values of the concentration and the purge must be determined at the respective purge ratios. Accordingly, step 503 at the TAU calculation step 500 explained with reference to FIG. 5 must be changed.

Figure 9:
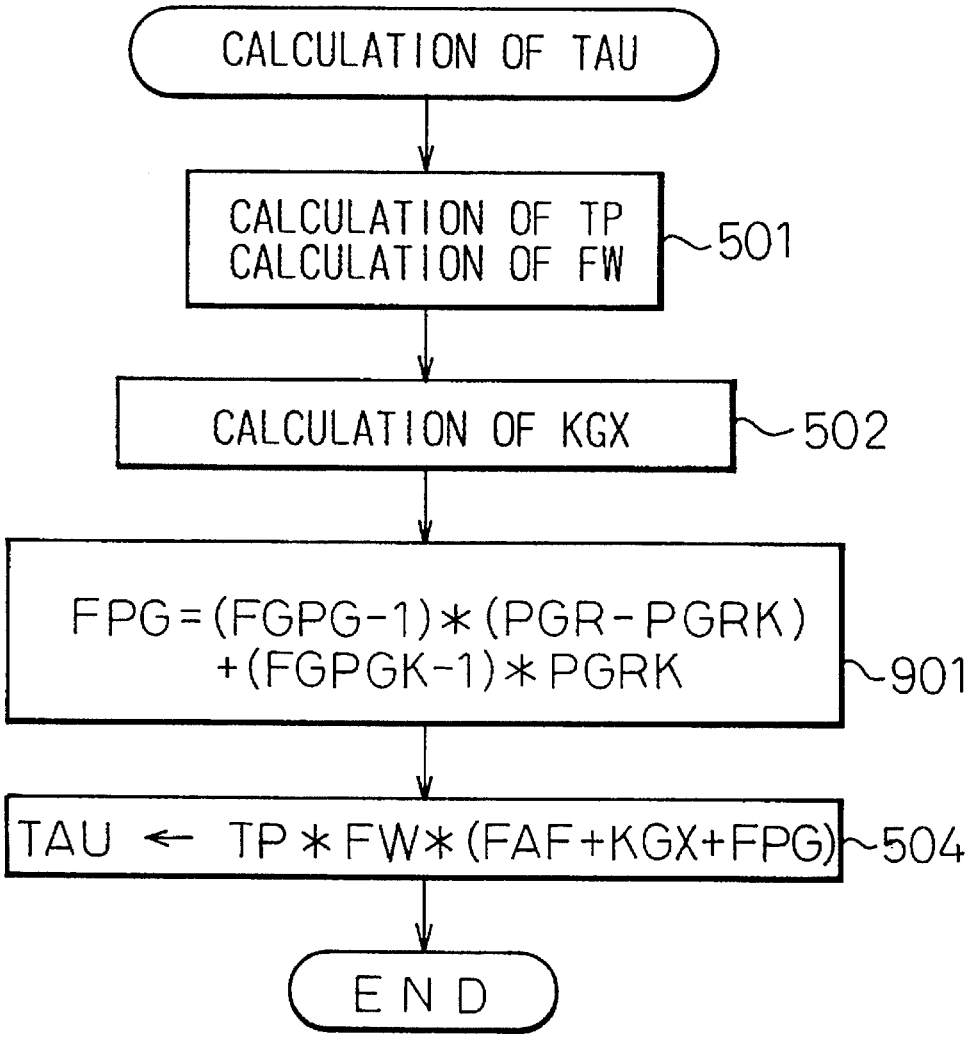
FIG. 9 is a flowchart showing the procedures of the fuel injection amount calculation corresponding to the control shown in the flowchart of FIG. 8.

FIG. 9 shows the procedure of the TAU calculation in the first embodiment, and like step numbers are used to identify like steps as in FIG. 5. Since the vapor concentrations are two in the first embodiment, i.e. the vapor concentration FGPG on the canister side and the vapor concentration FGPGK on the tank side, the purge air-fuel ratio correction amount FPG is calculated in accordance with the following formula at step 901 which is carried out next to step 502:

$$FP=(FGPG-1)\times(PGR-PGRK)+(FGPG-1)\times(PGRK)$$

Figure 10:
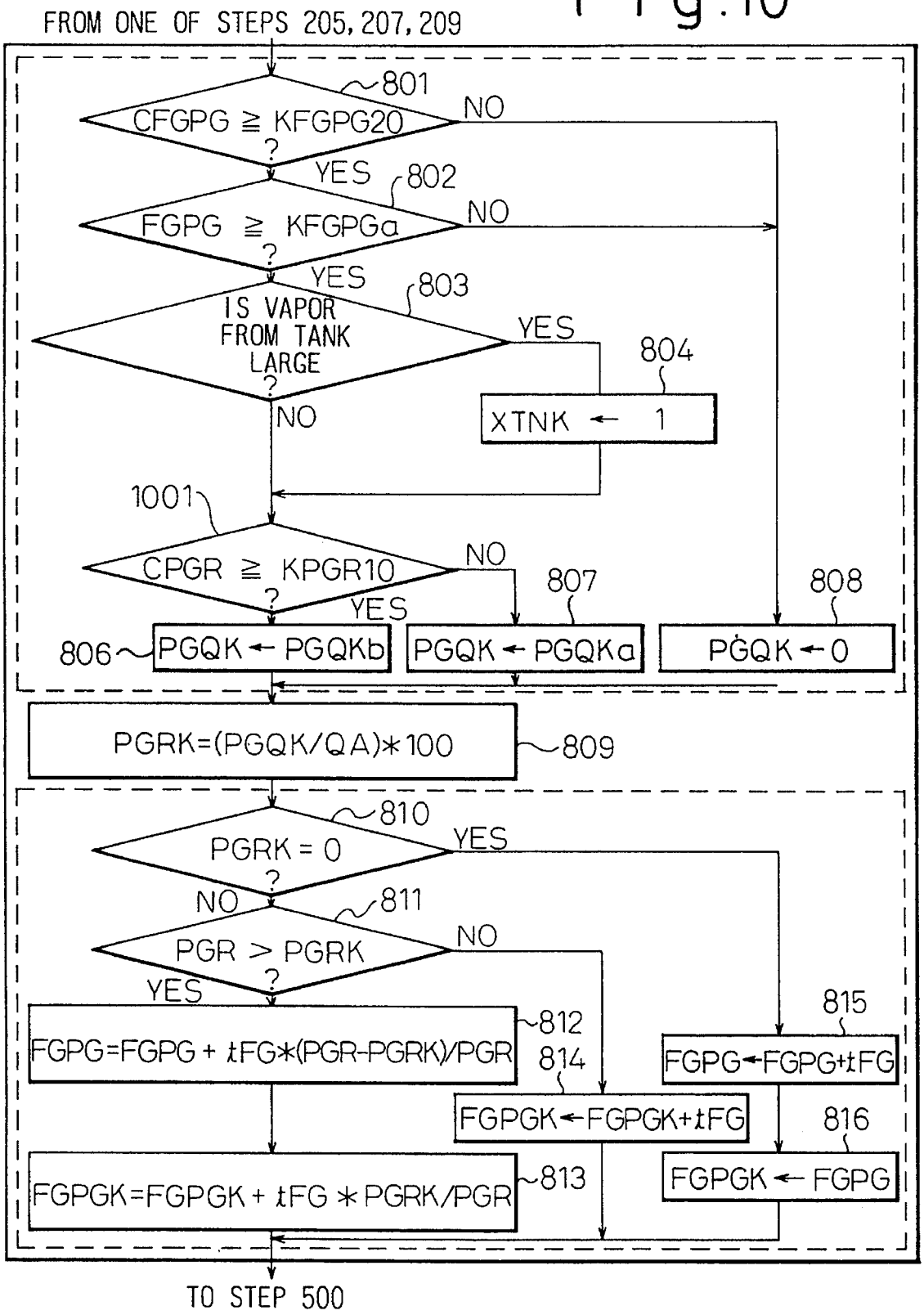
FIG. 10 is a flowchart of a modified embodiment of the first embodiment explained with reference to FIG. 9.

FIG. 10 shows a modified embodiment of the first embodiment explained with reference to FIG. 9. Like reference numerals are used to identify like process steps as in FIG. 9. In the first embodiment, whether the vapor concentration FGPG on the canister side is higher than the predetermined value KFG09 is judged at step 805, but in this modified embodiment, whether or not the purge execution timer CPGR is greater than the predetermined value KPGR10 is judged at step 1001 in place of step 805. When the vapor concentration FGPG, at which the relation CPGR≧KPGR10 is satisfied, is low, the flow proceeds to step 806 and the fixed purge flow amount PGQK is set to the set value PGQKb. The vapor concentration FGPG is getting lower when the value of the timer CPGR is larger. When the vapor concentration, at which the relation CPGR<KPGR10 is satisfied, is high, the flow proceeds to step 807 and the fixed purge flow amount PGQK is set to the set value PGQKa (<PGQKb).

Figures 11A, 11B:
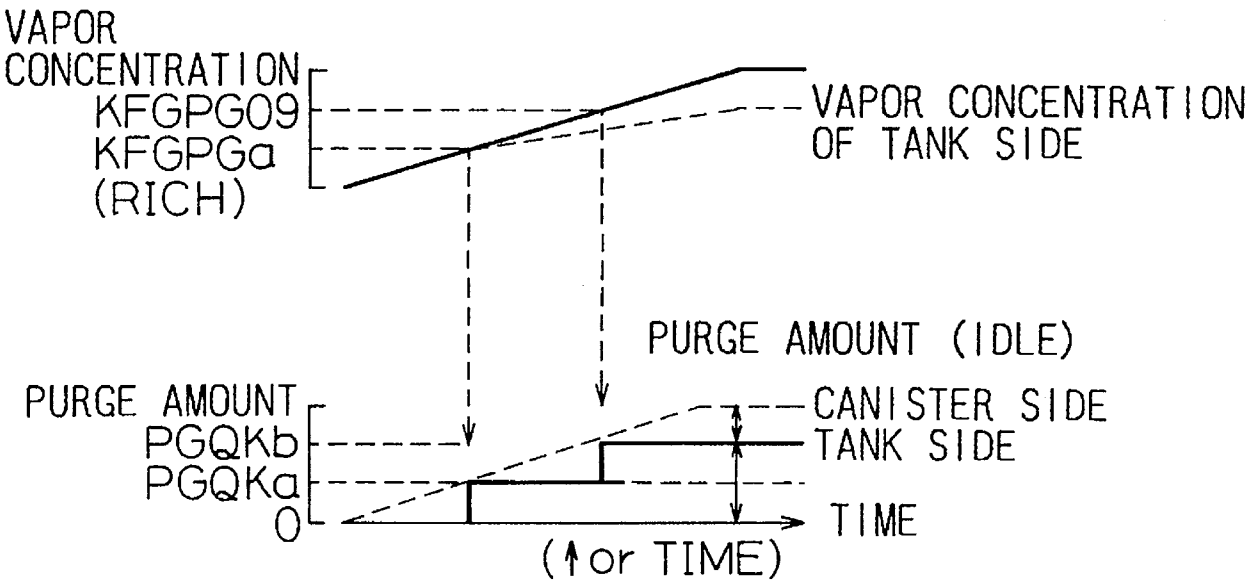
FIG. 11A is a diagram showing the change of a vapor concentration with respect to time on the basis of the procedure of the first embodiment shown in FIG. 8.
FIG. 11B is a diagram showing the change of a purging amount.

FIG. 11 shows the change of the vapor concentration (solid line represents the canister side and dotted line represents the tank side) on the basis of the procedure of the first embodiment shown in FIG. 8, and the change of the purge amount at this time (dotted line represents the canister side and solid line represents the tank side). As can be understood from this diagram, control for switching the fixed purge amount in the following way in accordance with the vapor concentration FGPG is carried out in the first embodiment:

(1) When FGPG<KFGPGa:
fixed purge amount PGQK=0

(2) When KFGPGa≦FGPG≦KFGPG09:
fixed purge amount PGQK=PGQKa (3) When FGPG≧KFGPG09:
fixed purge amount PGQK=PGQKb Due to this control, vapor release is fast when the vapor concentration of the canister is high, and erroneous learning of the respective vapor concentrations when the vapor concentrations are high can be avoided. As a result, controllability of the air-fuel ratio can be improved.

Figure 12:
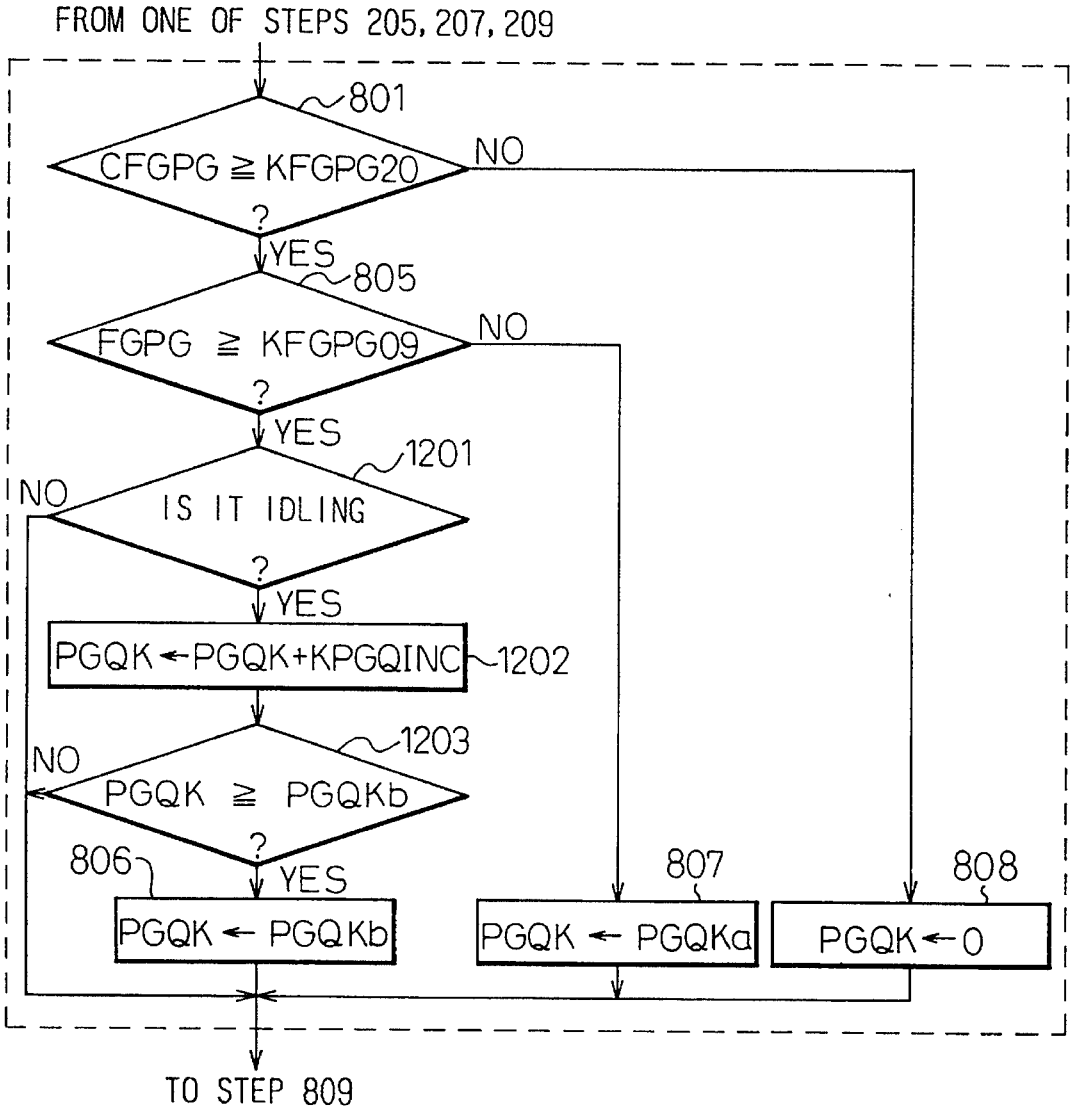
FIG. 12 is a flowchart showing the control of the second embodiment of the present invention, and showing a fixed purge flow set control portion of FIG. 8; 10

FIG. 12 shows the control of the second embodiment of the present invention. This control is a modified embodiment of the setting control of the fixed purge flow amount from the fuel tank side explained at steps 801 to 808 of FIG. 8. Therefore, like reference numerals are used to identify like steps as in FIG. 8.

In the setting control of the fixed purged flow amount from the fuel tank side in this second embodiment, whether or not the vapor concentration intake number CFGPG is greater than the predetermined number of times KFGPG20 is first judged at step 801. When CFGPG< KFGPG20, the flow proceeds to step 808 and the fixed purge flow amount PGQK is set to 0. On the other hand, when CFGPG≧KFGPG20 at step 801, the flow proceeds to step 805 and whether or not the vapor concentration FGPG on the canister side is greater than the predetermined value KFGPG09 is judged. When the vapor concentration FGPG, at which the relation FGPG<KFGPG09 is satisfied, is low, the flow proceeds to step 807 in the same way as in the first embodiment and the fixed purge flow amount PGQK is set to the set value PGQKa (<PGQKb).

When the vapor concentration FGPG, at which the relation FGPG≧KFGPG09 is satisfied, is high at step 805, on the other hand, the flow proceeds to step 1201 and whether or not the engine is idle is judged. When the engine is not idling, the flow proceeds as such to step 809 (see FIG. 8), and when it is idling, the flow proceeds to step 1202 and the fixed purge flow amount PGQK is increased by the predetermined value PGQK.

The subsequent step 1203 is a guard for preventing the fixed purge flow amount PGQK, which is increased at step 1202, from exceeding the set value PGQKb. When PGQK<PGQKb, the flow proceeds to step 809, and when PGQK≧PGQKb, the flow proceeds to step 806 and the maximum value of the fixed purge flow amount is guarded by PGQKb. The flow then proceeds to step 809.

In the first embodiment described already, the change of the vapor concentration occurs in the fixed purge flow amount with the increase of the air amount passing through the canister at the time of switch of the fixed purge flow amount. Therefore, there is the possibility that the air-fuel ratio is transiently out of matching at the time of switch of the fixed purge flow amount. In other words, as indicated by a dotted line in FIG. 13C, when the fixed purge flow amount PGQK is switched at one time, the air-fuel ratio correction amount changes and the air-fuel ratio becomes coarse as indicated by the dotted line in FIG. 13B due to the deviation of the vapor concentration indicated by an arrow in FIG. 13A. The second embodiment solves this problem. As indicated by the solid line in FIG. 13C, the fixed purge flow amount is increased while vapor concentration learning is increased within the updating range at the time of learning of the vapor concentration on the fixed purge flow amount side (at the time of skip of the air-fuel ratio). In this way, when the fixed purge flow amount ratio is increased, respective vapor leaning can be sequentially made, and improvement of learning accuracy of the vapor concentration at the time of switch of the fixed purge flow amount can be made smoothly and controllability of the air-fuel ratio can be improved.

Figure 14:
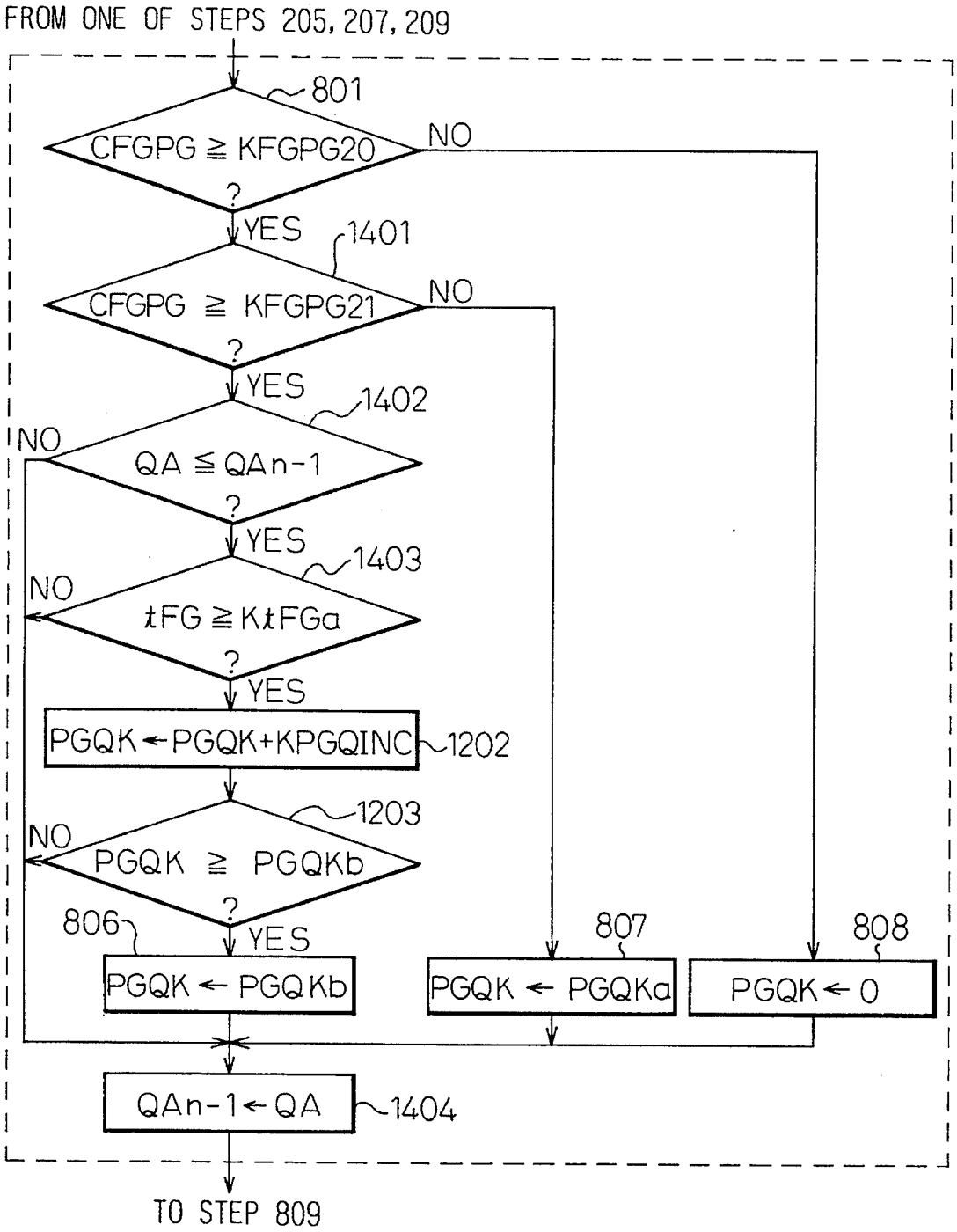
FIG. 14 is a flowchart showing the control of the third embodiment of the present invention, and showing a fixed purge amount set control portion of FIG. 8.

FIG. 14 shows the control of the third embodiment of the present invention. This control is a modified embodiment of the setting control of the fixed purge flow amount from the fuel tank side explained at steps 801 to 808 of FIG. 8, and is partially different from the control shown in FIG. 12. Therefore, like reference umerals are used to identify like process steps as those explained already.

In the setting control of the fixed purge flow amount from the fuel tank side in the third embodiment, whether or not the vapor concentration intake number CFGPG is greater than the predetermined number of times KFGPG20 is first judged at step 801 in the same way as in the foregoing embodiments. When CFGPG<KFGPG20, the flow proceeds to step 808 and the fixed purge flow amount PGQK is set to 0. On the other hand, when CFGPG≧KFGPG20 at step 801, the flow proceeds to step 1401 and whether or not the vapor concentration intake number CFGPG is greater than another predetermined number of times KFGPG21 (≧KFGPG20) is judged. When CFGPG< KFGPG21, the flow proceeds to step 807 and the fixed purge flow amount PGQK is set to the set value PGQKa.

When CFGPG≧KFGPG21 at step 1401, the flow proceeds to step 1402 and whether or not the intake air amount QA is smaller than the previous value QAn−1 is judged. When QA>QAn−1 at step 1402, the flow proceeds to step 1404. When QA≦QAn−1, the flow proceeds to step 1402 and whether or not the vapor concentration updating value tFG is greater than the predetermined value KtFGa is judged. When tFG<KtFGa at step 1402, the flow proceeds to step 1404. When tFG≧KtFGa, the flow proceeds to step 1202 and the fixed purge flow amount PGQK is increased by the predetermined value KPGQINC. Step 1203 is a guard for preventing the fixed purge flow amount PGQK from exceeding the predetermined value PGQKb. When GPQK<PGQKb, the flow proceeds to step 1404. When PGQK≧PGQKb, the flow proceeds to step 1404 and the maximum value of the fixed purge flow amount PGQK is guarded by PGQKb. The flow then proceeds to step 1404. At this step 1404, the intake air amount QA of this time is stored as the previous value QAn−1 and the flow proceeds to step 809.

In the third embodiment, the increase of the fixed purge flow amount PGQK is made when the purge ratio exists in the great direction and moreover, when the vapor exists in the great direction and moreover, when the vapor concentration updating value tFG exists in the lean direction. The state where the purge ratio is great is judged from the time when the intake air amount QA is smaller than the previous amount, at step 1402, and the time when the vapor concentration updating value tFG exists in the lean direction is judged from the state where the vapor concentration updating value tFG is greater than the predetermined value KtFGa, at step 1402.

Due this control, when the change of the vapor concentration of the canister is great, vapor concentration accuracy can be improved because the fixed flow amount value can be sequentially increased when the fixed purge flow amount purge ratio exists in the increasing direction even when the ratio of the fixed purge flow amount is small.

Figures 15A, 15B:
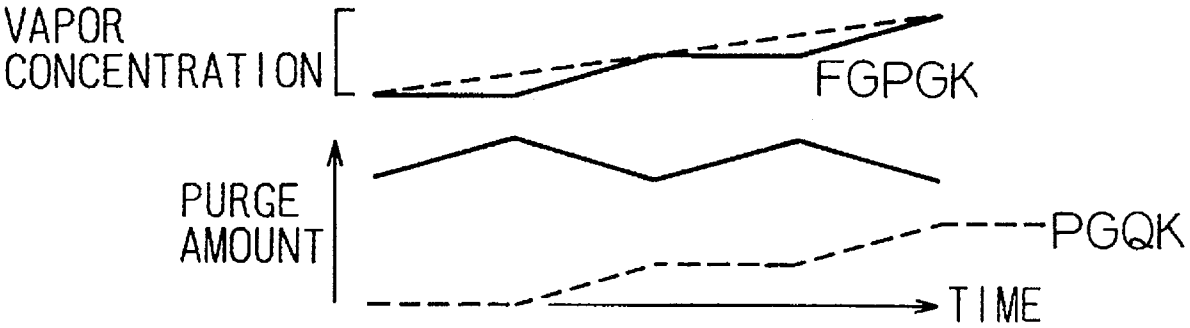
FIG. 15A is a diagram showing the change of a vapor concentration with respect to time on the basis of the procedure of the third embodiment shown in FIG. 14.
FIG. 15B is diagram showing the change of the purge amount.

The fixed purge flow amount PGQK of the tank side becomes larger with the passage of time as shown in FIG. 15(*b*). When the fixed flow amount PGQK becomes large, the ratio of the purge flow amount from the tank side in the total purge flow amount becomes large as shown in FIG. 15(*a*) with dotted line, thereby making the amount of updating value of the vapor concentration of the tank side FGPGK large at the updating period. As a result, the vapor concentration of the tank side FGPGK is updated with accuracy.

Figure 16:
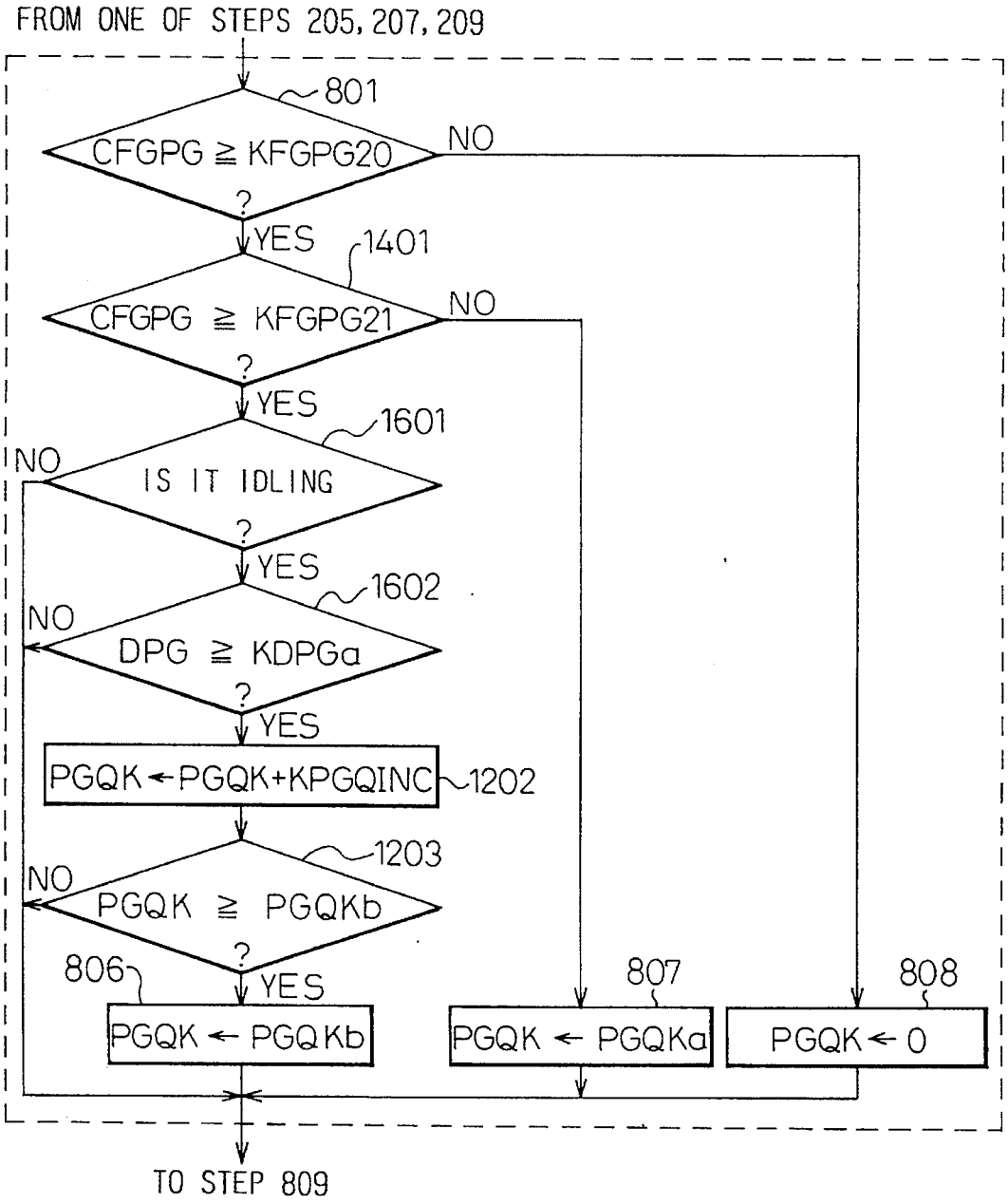
FIG. 16 is a flowchart showing the control of the fourth embodiment of the present invention, and showing the fixed purge amount set control portion of FIG. 8.

FIG. 16 shows the control of the fourth embodiment of the present invention. This control is a modified embodiment of the setting control of the fixed purge flow amount from the fuel tank side at steps 801 to 808 of FIG. 8, and is partially different from the control shown in FIG. 14. Therefore, like reference numerals are used to identify like process steps as those explained already, and only the different portions from the third embodiment shown in FIG. 14 will be explained.

In the setting control of the fixed purge flow amount from the fuel tank side in the fourth embodiment, the procedure of setting the fixed purge flow amount PGQK to 0 by the process steps 801 to 808 in the same way as in the third embodiment and the procedure of setting the fixed purge flow amount PGQK to the set value PGQKa at the process steps 801 to 1401 and at step 807 when the vapor concentration intake number CFPG is less than KFGPG21 are the same. Then, the flow proceeds to step 1401, and when CFGPG≧KFGPG21, the flow proceeds to step 1601.

At this step 1601, whether or no the engine is idle is judged, and when it is not idle, the flow proceeds to step 809. When the engine is idle, the flow proceeds to step 1602. Whether or not the actual purge ratio is great is judged from whether or not the duty value DPG used is greater than the predetermined value KDPGa, at step 1602. When DPG<KDPGa at step 1602, the flow proceeds as such to step 809, and when DPG≧KDPGa, the flow proceeds to step 1202 and the fixed purge flow amount PGQK is increased by the predetermined value KPGQINC. Step 1203 is a guard for preventing the fixed purge flow amount PGQK exceeding the set value PGQKb. When PGQK<PGQKb, the flow proceeds to step 1404, and when PGQK≧PGQKb, the flow proceeds to step 806. At this step 806, the maximum value of the fixed purge flow amount is guarded by PGQKb, and the flow then proceeds to step 809.

Figure 17:
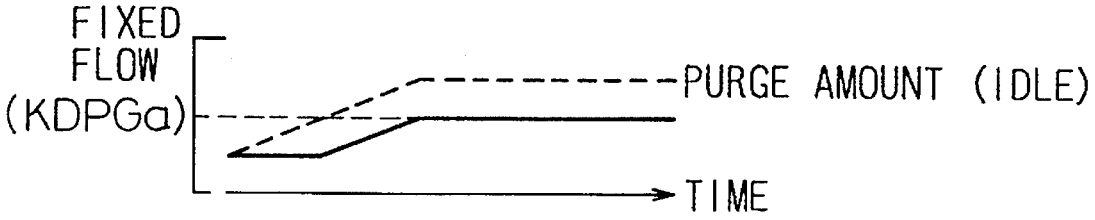
FIG. 17 is a diagram showing the change of the fixed flow with respect to time on the basis of the procedure of the fourth embodiment shown in FIG. 16.

In the third embodiment, the time when the fixed purge flow amount ratio is great is judged from the time when the intake air amount QA is small, but this is judged by whether or not the engine is idling in this fourth embodiment. At the subsequent step 1602, the actual purge flow amount is judged from whether or not the duty ratio is greater than the predetermined value, and the fixed purge flow amount is increased when the duty ratio is greater. FIG. 17 shows this state. The fixed purge flow amount (indicated by dotted line) at the time of idling is increased when the duty ratio indicated by the solid line is greater than the judgment value KDPGa.

Figure 18:
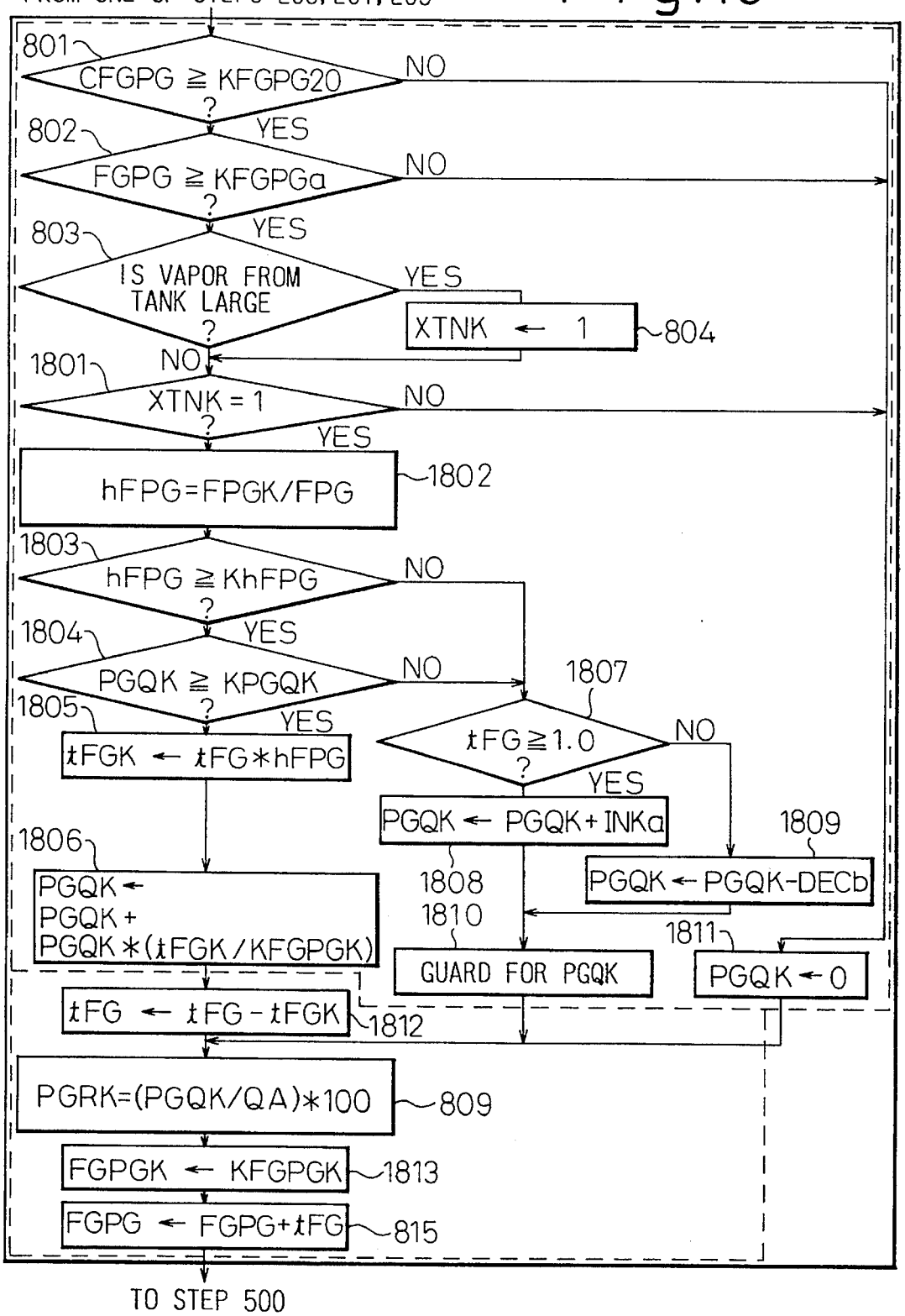
FIG. 18 is a flowchart showing the control of the fifth embodiment of the present invention, and showing in detail another control example of step 210 in purge concentration learning control explained with reference to FIG. 2.
Figures 19A, 19B, 19C, 19D, 19E:
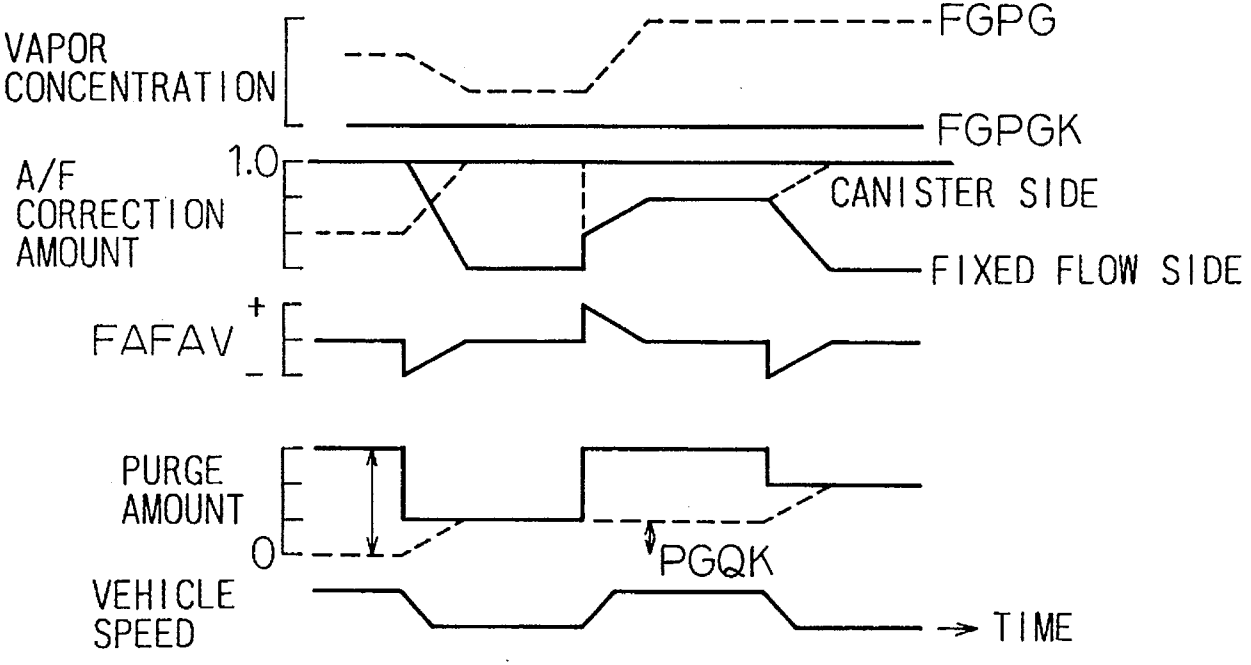
FIG. 19A is diagram showing the change of the vapor concentration with respect to time on the basis of the procedure of the fifth embodiment shown in FIG. 18.
FIG. 19B is a diagram showing the change of the air-fuel ratio correction amount.
FIG. 19C is a diagram showing the change of a mean value of the air-fuel ratio feedback correction amount.
FIG. 19D is a diagram showing the change of the purge amount.
FIG. 19E is a diagram showing the change of a car speed; 10

FIG. 18 shows the control of the fifth embodiment of the present invention. This control is a modified embodiment of the control procedure explained with reference to FIG. 8.

Therefore, like reference numerals are used to identify like process steps as those explained already.

In the setting control of the fixed purge flow amount from the fuel tank side, whether or not the vapor concentration intake number CFGPG is greater than the predetermined number of time KFGPG20 is first judged at step 801. When CFGPG≧KFGPG20, the flow proceeds to step 802, and when CFGPG<KFGPG20, the flow proceeds to step 1811. At step 802, whether or not the vapor concentration FGPG from the canister side is greater than the predetermined value KFGPGa is judged, and when FGPG≧KFGPGa, the flow proceeds to step 803. When FGPG< KFPGa, the flow proceeds to step 1811. At step 803, whether or not the vapor on the tank side is great is judged, and when it is great, a flag XTNK representing the condition where the occurrence of the vapor is great in the fuel tank is set to 1 at step 804.

When the vapor on the tank side is not great at step 803, the flow proceeds to step 1811, and whether or not the flag XTNK representing the condition where the occurrence of the vapor is great in the fuel tank is 1 is judged at this step 1811. When XTNK=1, the flow step 1801, and when not, the flow proceeds to step 1811. At step 1802, an air-fuel ratio correction ratio hFPG is calculated by dividing the air-fuel ratio correction amount FPGK on the tank side by the air-fuel ratio correction amount FPG on the canister side in accordance with the following formula:

$$hFPG=FPGK/FPG$$

At the subsequent step 1803, whether or not the air-fuel ratio correction ratio hFPG is greater than the predetermined value KhFPG is judged. When hFPG≧khFPG, the flow proceeds to step 1804 and when hFPG<khFPG, the flow proceeds to step 1087. At step 1804, whether or not the fixed purge amount PGQK is greater than the predetermined value KPGQK is judged. When PGQK<KPGQK, the flow proceeds to step 1807 and when PGQK≧KPGQK, the flow proceeds to step 1805.

At step 1805, the product obtained by multiplying the vapor concentration updating value tFG by the air-fuel ratio correction ratio hFPG is stored as the vapor concentration updating value tFGK on the tank side (fixed side). At the subsequent step 1806, the fixed purge flow amount PGQK is calculated in accordance with the following formula and the flow proceeds to step 1812:

$$PGQK=PGQK+PGQK\times(tFGK/KFGPGK)$$

At step 1812, the value obtained by subtracting the vapor concentration updating value tFGK on the fixed side from the vapor concentration updating value tFG is stored as a new vapor concentration updating value tFG.

On the other hand, whether or not the vapor concentration updating value tFG is greater than 1 is judged at step 1807. When tFG≧1, the fixed purge flow amount PGQK is increased by a predetermined value INKa at step 1808, and when tFG<1, the fixed purge flow amount is decreased by a predetermined value DECbv at step 1809. At the subsequent step 1810, the upper and lower limit processing of the fixed purge flow amount PGQK is executed.

At the subsequent step 809, the fixed flow amount purge ratio PGRK is calculated in accordance with the following formula:

$$PGRK\leftarrow(PGQK/QA)\times100$$

After the fixed flow amount purge ratio PGRK is calculated at step 809, the predetermined value KFGPGK is applied to the vapor concentration FGPGK on the fixed side at step 1813. At the subsequent step 815, the vapor concentration FGPG is updated by the sum of the vapor concentration FGPG on the canister side and the vapor concentration updating value tFG, and the flow then proceeds to the calculation processing step 500 of the fuel injection amount TAU.

In the fifth embodiment described above, the air-fuel ratio correction ratios on the tank side and the canister side are determined before updating of the vapor concentration (step 1803), and when the ratio on the tank side is small, the purge amount PGQK on the tank side is sequentially changed in accordance with the direction of the vapor concentration learning (+direction or −direction) and furthermore, the purge amount PGQK on the tank side is determined on the basis of the vapor concentration KFGPGK representing the air-fuel ratio correction ratio and the tank vapor, at step 1806.

According to the procedure of the fifth embodiment, the vapor amount from the fuel tank can be anticipated, and the purge flow amount on the canister side can be corrected as much, so that air-fuel ratio correction an be made correctly, too. Since updating is made on the basis of the actual air-fuel ratio correction ratio, the delay of updating of the flow amount of the tank side in comparison with updating on the basis of the purge flow amount ratio can be eliminated. In other words, whereas the vapor concentration obtained from the purge flow amount ratio is diluted by the atmosphere of the canister, the tank representive vapor in the fifth embodiment is rich and the purge amount on the tank side is small as mich. Accordingly, updating of the flow amount on the tank side is retarded in updating which is based on the purge amount ratio.

FIGS. 19A to 19E show the changes, with time, of the vapor concentration, the air-fuel ratio correction amount, the mean value of the air-fuel ratio feedback correction amount, the purge amount and the car speed, respectively, in the control procedure described above.

Figure 20:
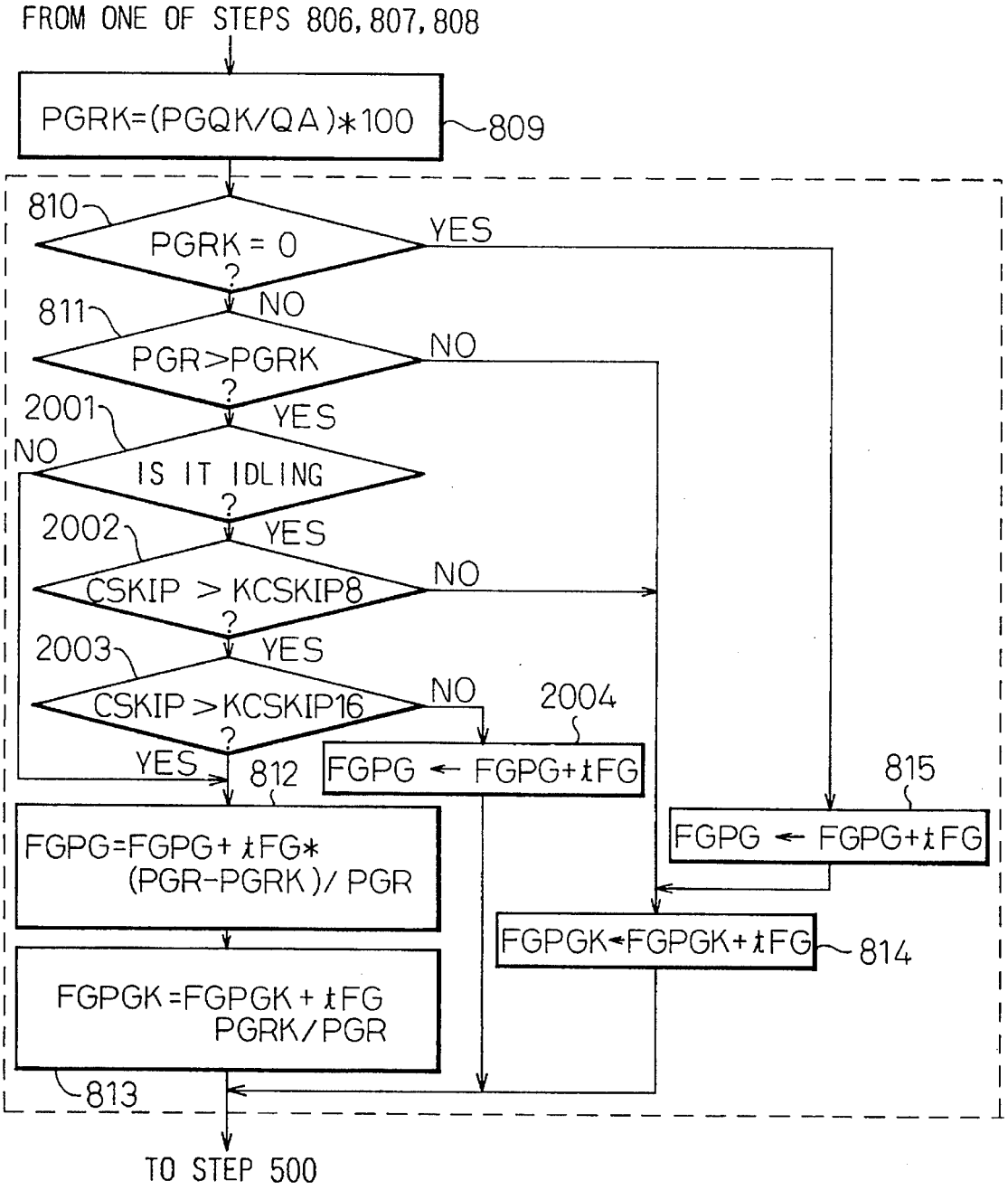
FIG. 20 is a flowchart showing the control of the sixth embodiment of the present invention, and showing in detail another control example of a vapor concentration updating control explained with reference to FIG. 8.

FIG. 20 shows the control of the sixth embodiment of the present invention. This control is a modified embodiment of the vapor concentration updating control explained with reference to FIG. 8. Therefore, FIG. 20 shows the procedure of only the portion of the vapor concentration updating control in FIG. 8, and like reference numerals are used to identify like process steps as those explained already.

In the vapor concentration updating control according to the sixth embodiment, when the purge ratio PGRK of the fixed flow amount is 0 at step 810, the flow proceeds to step 815 in the same way as in the first embodiment. When PGRK≠0, the flow proceeds to step 811, and whether or not the purge ratio PGR is greater than the fixed flow amount purge ratio PGRK is judged. When PGR≦PGRK, the flow proceeds to step 814. At the next step 815, the vapor concentration FGPG on the canister side is updated by adding the vapor concentration updating value tFG. At this time, the vapor concentration FGPGK on the tank side is updated by adding the vapor concentration updating value tFG on the tank side at step 814, and the flow then proceeds to the calculation processing step 500 of the fuel injection amount TAU.

When the result of judgement proves PGR>PGRK at step 811, on the other hand, the flow proceeds to step 2001. At this step 2001, whether or not the engine is idle is judged at step 2001. When the engine is not idle, the flow proceeds to step 812, and when the engine is idle, the flow proceeds to step 2002 so as to judge whether or not the skip number is greater than the predetermined value KCSKIP8. When CSKIP≦KSKIP8, the flow proceeds to step 814 and the vapor concentration on the tank side is updated. When CSKIP>KCSKIP8, the flow proceeds to step 2003, and whether or not the skip number is greater than the predetermined number KCSKIP16 (>KCSKIP18) is judged. When CSKIP≦KCSKIP16, the flow proceeds to step 2004, and the vapor concentration FGPG on the canister side is updated by adding the vapor concentration updating value tFG. When CSKIP>KCSKIP16, the flow proceeds to step 812. At this step 812, the vapor concentration on the canister side (changing side) is updated in accordance with the following formula and after the vapor concentration FGPGK on the tank side (fixed side) is updated at the subsequent step 813, the flow proceeds to step 500.

In the sixth embodiment, the control from steps 2001 to 2004 is added between steps 811 and 812 of the first embodiment, the vapor concentration FGPGK on the fixed flow amount side is updated in a first specific time (CSKIP≦KCSKIP8) so as to increase the vapor concentration FGPGK on the fixed flow amount side. In the next specific time (KCSKIP8<CSKIP≦KCSKIP16) in which the purge amount is increased, the vapor concentration FGPG on only the canister side is updated. As a result, erroneous learning after the improvement of vapor concentration accuracy on the fixed flow amount side can be eliminated.

The reason why this erroneous learning can be eliminated will be explained. When the purge amount is reduced, learning on the fixed flow amount side can be done well, but when the purge amount is again increased next, the vapor is diluted by air passing through the canister. Then, although leaning is made while the concentration on the tank side is increased, the vapor concentration becomes low by increasing the purge amount, so that erroneous learning occurs. In this case, the direction in which the vapor concentration becomes low exists on the canister side. Therefore, the factor for reducing the vapor concentration is taken only into the canister side. Accordingly, when the operation state of the engine is judged as idle at step 2001, learning of the vapor concentration on only the fixed flow amount side is made if the number of skips is within 8 skips at step 2002. In other words, since control is made to the fixed flow amount within 8 skips, learning of the vapor concentration on only the fixed flow amount side is made. The time of the subsequent 8 skips is judged at step 2003, and the vapor concentration on only the canister side is updated at this time. In this way, the sixth embodiment discriminates whether the vapor concentration on the canister side or on the tank side is to be learned from the number of times of learning. Incidentally, the counter CSKIP effects its count-up operation for each skip of feedback, that is, at the time of inversion of the $O_2$ sensor, as explained with reference to step 408 of FIG. 4.

Figures 22A, 22B, 22C:
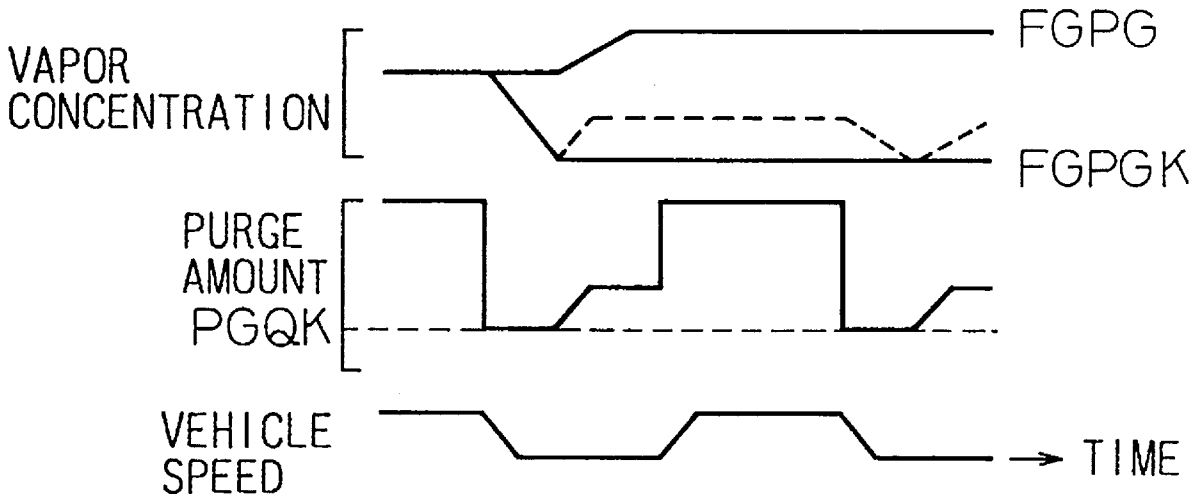
FIG. 22A is a diagram showing the change of the vapor concentration with respect to time in the procedure of the sixth embodiment shown in FIG. 20.
FIG. 22B is a diagram showing the change of the purge flow.
FIG. 22C is a diagram showing the change of the car speed.

FIGS. 22A to 22C show the changes of the vapor concentration and the purge amount with the change of the car speed with respect to time in the sixth embodiment. Dotted line of the vapor concentration characteristics represents the characteristics when the vapor concentration is updated by only the purge flow amount ratio, and in this case, the vapor concentration fluctuates.

Figure 21:
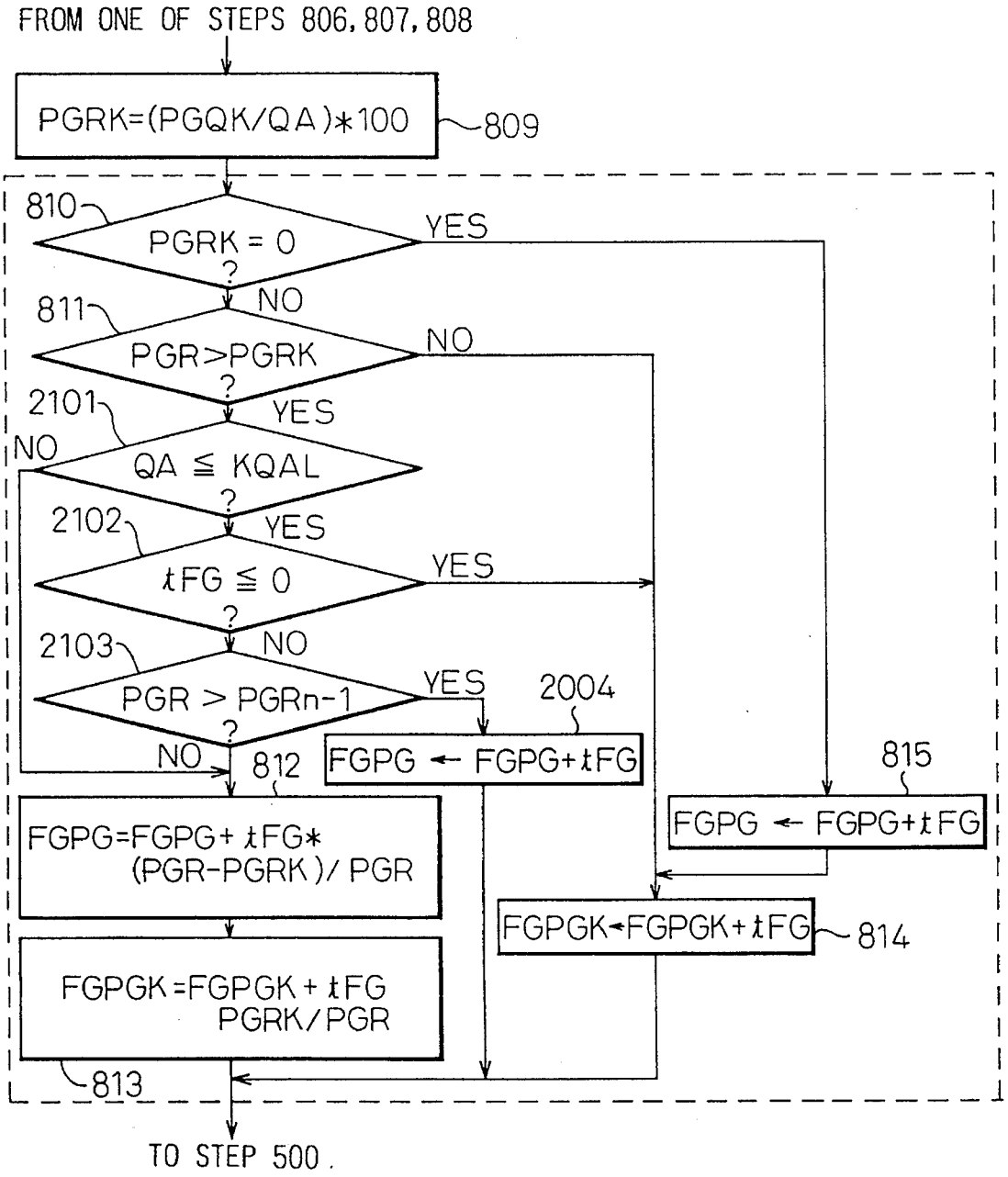
FIG. 21 is a flowchart showing the control of the seventh embodiment of the present invention, and showing in detail another control example of the vapor concentration updating control portion explained with reference to FIG. 8.

FIG. 21 shows the control of the seventh embodiment of the present invention. This control is a modified embodiment of the vapor concentration updating control explained with reference to FIG. 21. Therefore, like reference numerals are used to identify like process steps as those in FIG. 20, and only the different portions will be explained.

The difference of the seventh embodiment shown in FIG. 21 from the sixth embodiment shown in FIG. 20 resides only in that steps 2101 to 2103 are carried out in place of steps 2001 to 2003. At step 2101, whether or not the intake air amount this time is smaller than the predetermined value KQAL is judged, and whether or not the vapor concentration updating value tFG is 0 is judged at step 2102. Further, at step 2103, whether or not the purge ratio PGR is greater than the previous purge ratio PGRn−1 is judged. When QA>KQAL at step 2101, the flow proceeds to step 812, and when QA≦KQAL, the flow proceeds to step 2102. When tFG≦0 at step 2102, the flow proceeds to step 814 and the vapor concentration on the tank side is updated. When tFG>0, the flow proceeds to step 2103. When PGR>PGRn−1 at step 2103, the flow proceeds to step 2004, and the vapor concentration FGPG on the canister side is updated by adding the vapor concentration updating value tFG. When PGR≦PGRn−1, the flow proceeds to step 812 and the vapor concentration FGPG on the canister side (changing side) is updated as already described.

Basically, the vapor concentration on the tank side becomes high while it becomes low on the canister side during purging, as already described. Accordingly, in this embodiment, learning of the vapor concentration is executed towards the direction which the vapor concentration moves, when the influence of the vapor concentration is great. In other words, the vapor concentration is divided in accordance with the learning direction of the vapor. More concretely, when the intake air amount QA is great at step 2101, the flow proceeds to step 812, and when the intake air amount QA is small, the case where the updating value tFG of the vapor concentration is below 0 is judged and the vapor concentration on only the tank side is updated at step 814. When the vapor concentration changes in the decreasing direction, on the contrary, the flow proceeds from step 2102 to step 2103. When the purge ratio is greater than the previous ratio, the vapor concentration on only the canister side is updated. In other words, when the air amount is small such as when the engine is idle and moreover, the vapor concentration changes in the increasing direction, for example, the vapor concentration on only the tank side is learned. When the vapor concentration changes in the decreasing direction and moreover, when the purge ratio is greater than the previous ratio, on the contrary, the vapor concentration on only the canister side is fixed. At other times, the flow proceeds to step 812 and control is executed in the same way as before.

As described above, the seventh embodiment judges the specific operation condition such as idling by the intake air amount QA, detects deviation of the vapor concentration on the fixed flow amount side or on the canister side by the changing direction of the vapor concentration at the time, and updates the vapor concentration on the canister side or the tank side on the basis of this detection result. According to this procedure, the updating speed of the vapor concentration becomes higher than when the vapor concentration is updated by the purge amount ratio, and air-fuel ratio controllability can be improved as much. This is because updating by the basic vapor concentration change can be made within the region in which the intake air amount is small and stable.

Figures 23A, 23B, 23C:
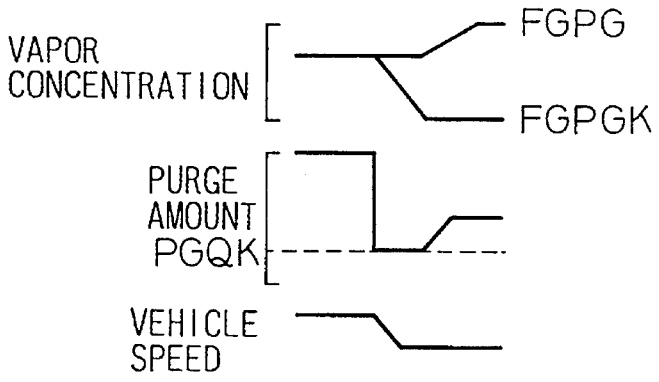
FIG. 23A is a diagram showing the change of the vapor concentration with respect to time in the procedure of the seventh embodiment shown in FIG. 21.
FIG. 23B is a diagram showing the change of the purge flow.
FIG. 23C is a diagram showing the change of the car speed.

FIGS. 23A to 23C show the change characteristics of the vapor concentration and the purge amount in accordance with the change of the car speed with respect to time in the seventh embodiment. As shown in FIG. 23A, it can be understood that the vapor concentration on the canister side and the vapor concentration on the tank side are updated in the updating direction of the vapor concentration, respectively, at the time of the specific operation such as idling.

Next, an embodiment wherein the present invention is applied to the purge control routine explained with reference to FIG. 6 will be explained.

Figure 24:
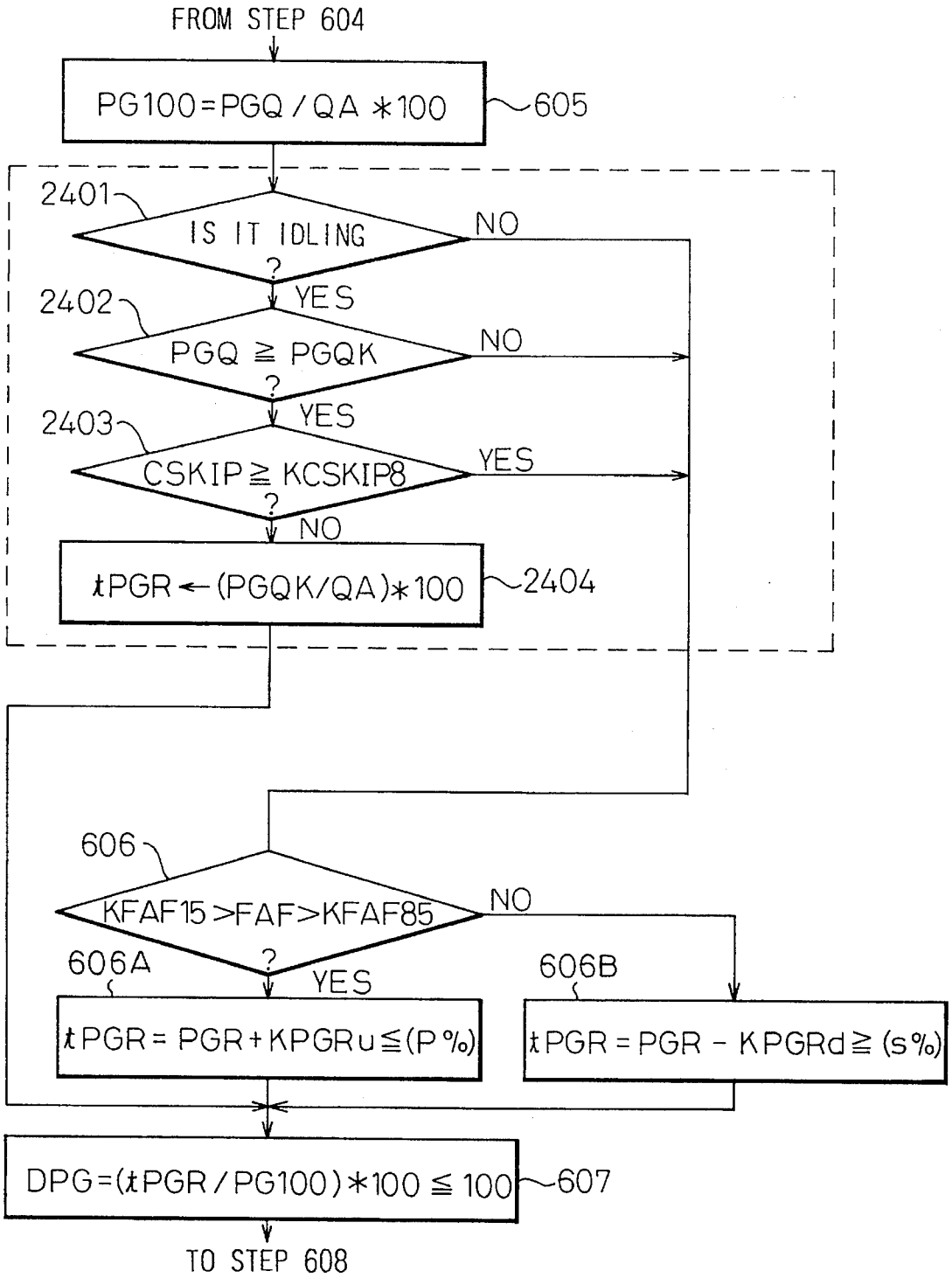
FIG. 24 is a flowchart showing the control of the eighth embodiment of the present invention, and showing the case where a part of the purge control routine explained in FIG. 6 is changed.

FIG. 24 shows the control of the eighth embodiment of the present invention. In this control, a fixed purge flow amount control is interposed between steps 605 and 606 of the purge control routine explained in FIG. 6. Therefore, FIG. 24 shows, in extraction, the principal portions of the control procedure of FIG. 6, and like reference numerals are used to identify like process steps as in FIG. 6.

In the eighth embodiment, the purge ratio PG100 when the D-VSV 26 is fully open is calculated at step 605, and whether or not the engine is idle is then judged at step 2401. When the engine is not idle, the flow proceeds as such to step 606, and when the engine is idle, the flow proceeds to step 2402. AT this step 2402, whether or not the purge flow amount PGQ is greater than the fixed purge flow amount PGQK on the tank side is judged. When PGQ<PGQK, the flow proceeds to step 606, and when PGQ≧PGQK, the flow proceeds to step 2403. At this step 2403, whether or not the skip number CSKIP of the air-fuel ratio is greater than the predetermined value KCSKIP8 is judged. When CSKIP<KCSKIP8, the flow proceeds to step 606 and when CSKIP≧KSCKIP8, the flow proceeds to step 2404. At step 2404, the target purge ratio tPGR is set in accordance with the following formula and the flow then proceeds to step 607:

$$tPGR=(PGQK/QA)\times 100$$

Since the processing at steps 606 and 607 have already been explained, its explanation will be hereby omitted.

In order to effect the air-fuel ratio correction in consideration of the fixed flow amount on the tank side, accuracy of the vapor concentration at that time must be improved. To accomplish this object, there is a method which decreases the purge amount in purge flow control and increases the purge ratio of the fixed flow amount besides the method which increases the purge ratio by increasing the fixed flow amount value. The eighth embodiment improves accuracy of the vapor concentration on the fixed flow amount side by decreasing the purge ratio to increase the purge ratio on the fixed flow amount.

Therefore, in this eighth embodiment, the practical purge ratio (purge flow amount) is reduced within a specific time, that is, within a specific a skip. More concretely, learning is made on only the fixed flow amount (tank side) within a certain skip range (fundamentally, eight times) when the engine is idling and the purge flow amount is small and moreover, when the purge flow amount is greater than the fixed flow amount. When the purge ratio on the tank side is increased in this way, accuracy of the vapor concentration on the tank side can be improved. Because this control is carried out under the idling condition where the purge amount is originally small, the control can be effected without a large drop of the purge amount.

Figures 25A, 25B, 25C:
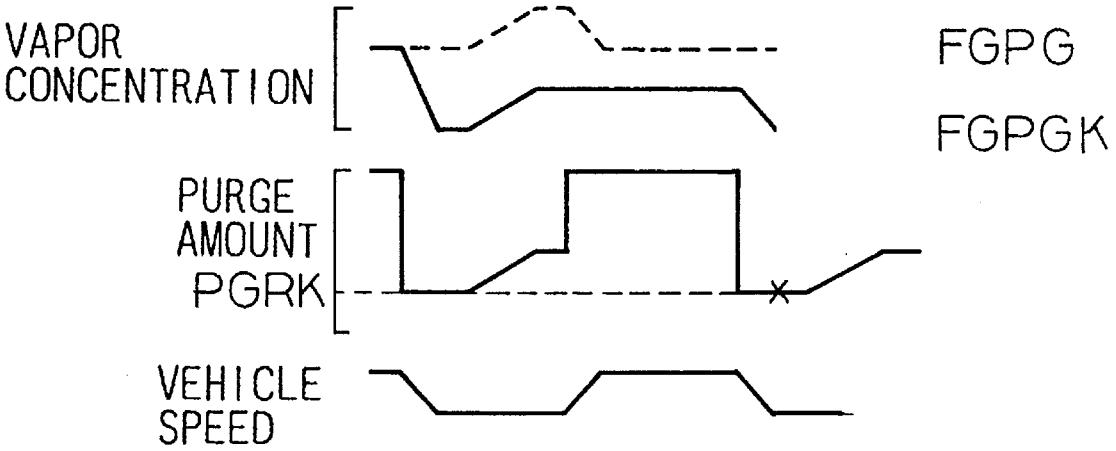
FIG. 25A is a diagram showing the change of the vapor concentration with respect to time in the procedure of the eighth embodiment shown in FIG. 24.
FIG. 25B is a diagram showing the change of the purge amount.
FIG. 25C is a diagram showing the change of the car speed.

FIGS. 25A to 25C show the change characteristics of the vapor concentration and the purge amount with the change of the car speed with respect to time in the eighth embodiment. As indicated by symbol X in FIG. 25B, the purge amount is reduced for a specific time when the car speed does not exist, and in this way, the vapor concentration on the tank side with respect to the purge amount can be increased.

FIG. 26 shows a control example of the ninth embodiment of the present invention. This embodiment is a modified example of the fixed purge flow amount control of the eighth embodiment explained with reference to FIG. 24, and only the difference from the eighth embodiment resides in step 2601. In the eighth embodiment, the flow proceeds to step 2403 when PGQ≧PGQK at step 2402, and whether or not the skip number is less than a predetermined value is judged. In this ninth embodiment, when PGQ≧PGQK at step 2402, whether or not the vapor concentration updating value tFG is 0 is judged at step 2602 and only this point, this embodiment is different from the eighth embodiment. Whereas the vapor concentration updating value on the fixed flow amount side is constant in the eighth embodiment, the flow proceeds to step 2402 until the vapor concentration updating value tFG is 0 in this ninth embodiment and the purge flow amount is set to a small value.

According to this control, the waiting time for a predetermined time required in the control shown in FIG. 24 is not necessary, and the purge can be increased when the vapor concentration is suitable, that is, tFG=0, and the vapor concentration can be reliably updated when the vapor concentration is out of matching. In other words, updating accuracy of the vapor concentration can be improved while preventing the drop of the purge amount.

FIGS. 27A to 27C show the change characteristics of the vapor concentration updating value and the purge amount with the change of the car speed with respect to time in the ninth embodiment. As shown in FIGS. 25A and 25B, the purge amount of the tank vapor is small when tFG<0, that is, rich.

Figure 28:
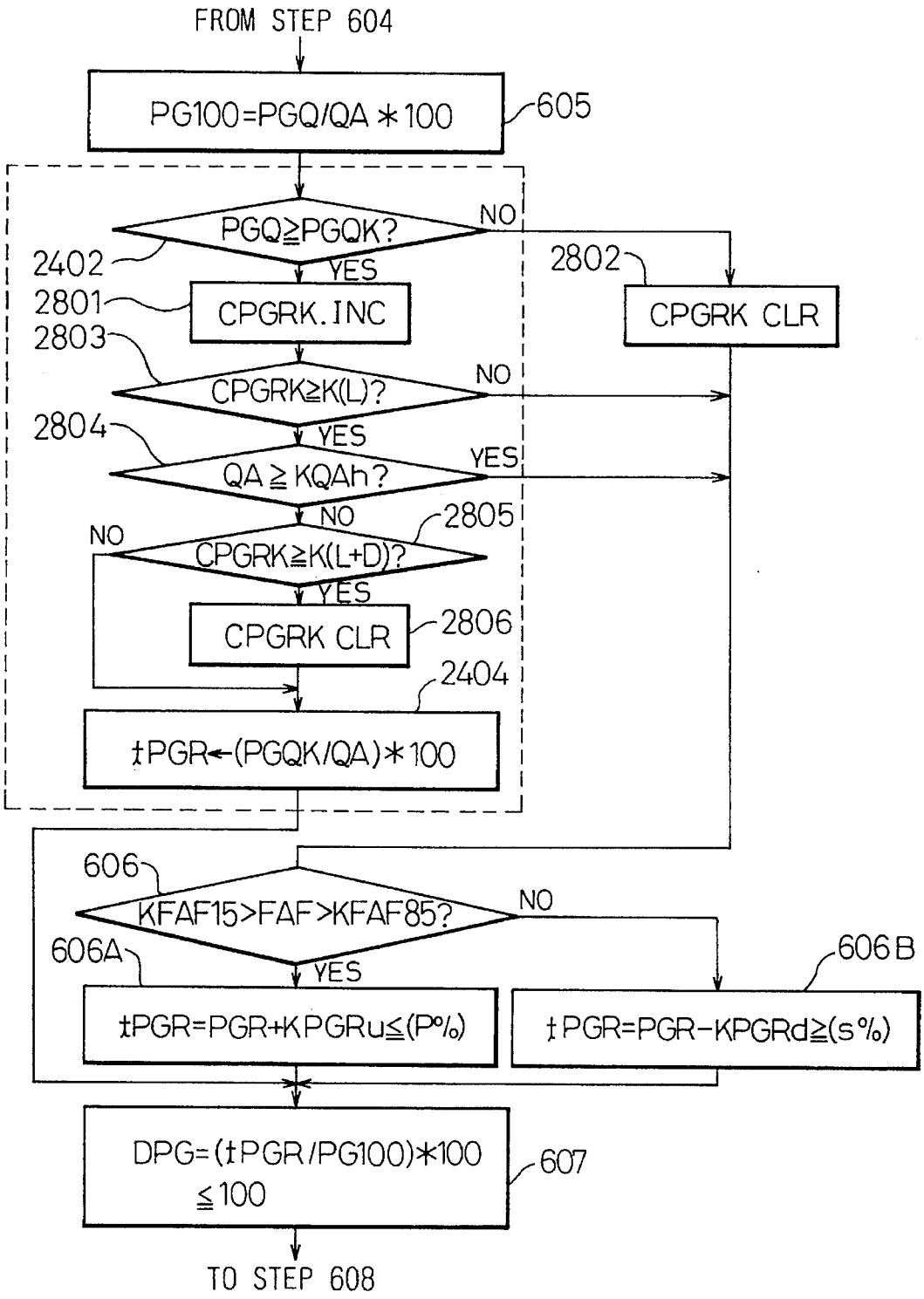
FIG. 28 is a flowchart showing the control of the tenth embodiment of the present invention, and showing the case where a part of the purge control routine explained with reference to FIG. 6 is changed.

FIG. 28 shows the control of the tenth embodiment of the present invention. In this embodiment, a separate fixed purge amount control is inserted between steps 605 and 606 of the purge control routine shown in FIG. 6. Accordingly, FIG. 28 shows the control procedure of the same portions as those the control procedure of FIG. 24 and like reference numerals are used to identify like process step as in FIG. 24.

In the tenth embodiment, the purge ratio PG100 when the D-VSV 26 is fully open is calculated at step 605, and whether or not the purge flow amount PGQ is greater than the fixed purge flow amount PGQK on the tank side is judged at step 2402. When PGQ<PGQK, the flow proceeds to step 2802, and after the purge execution timer CPGRK on the tank side is cleared, the flow proceeds to step 606. When PGQ≧PGQK at step 2402, the flow proceeds to step 2801, and the purge execution timer CPGRK on the tank side is incremented. The flow then proceeds to step 2803. As this step 2803, whether or not the purge execution timer CPGRK on the tank side is greater than the predetermined time K(L) and when CPGRK< K(L), the flow proceeds to step 606. When CPGRK≧K(L), the flow proceeds to step 2804, and whether or not the intake air amount QA for each specific time is greater than the predetermined value KQAh is judged. When AQ< KQAh, the flow proceeds to step 606 and when QA≧KQAh, the flow proceeds to step 2805.

At step 2805, whether or not the purge execution timer CPGRK on the tank side is another predetermined time K(L+D) greater than the predetermined time K(L) is judged, and when CPGRK<K(L+D), the flow proceeds as such to step 2404. When CPGRK≧K(L+D), the purge execution timer CPGRK on the tank side is cleared at step 2806, and the flow then proceeds to step 2404. After the target purge ratio tPGR is set in accordance with the following formula at step 2404, the flow proceeds to step 607:

$$tPGR=(PGQK/QA)\times 100$$

Since the processing at steps 606 and 607 has already been explained, the explanation will be omitted.

Figure 29:
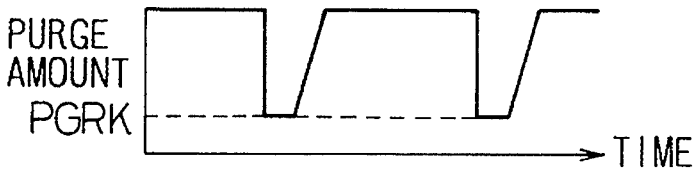
FIG. 29 is a diagram showing the change of the purge amount with respect to time in the procedure of the tenth embodiment shown in FIG. 28.

The control in the foregoing embodiments up to the ninth embodiment is extremely advantageous in the case where the idling condition suitably exists such as driving of the car in the town. On the other hand, when the idling state does not frequently exist in the driving state of the car, there is the case where accuracy of the vapor concentration on the fixed flow amount side drops. The tenth embodiment is directed to avoid this problem. Namely, when the intake air amount QA is smaller than the predetermined value KQAh (step 2804) and the influences of the purge vapor on the air-fuel ratio are great, the purge amount is reduced. In other words, in this embodiment, the flow amount of the purge is reduced for each certain time as shown in FIG. 29 and accuracy of the concentration of the fixed flow amount is improved by increasing the ratio of the fixed flow amount. When the intake air amount is great, on the other hand, execution of this control lowers the purge ratio and eventually, lowers accuracy, too. Therefore, this control is not effected when the intake air amount is great. This control is effected in a predetermined interval during driving of the car.

According to this control, the vapor concentration on the fixed flow amount side can be updated with high accuracy even in the continuous operation state where the idling operation does not exist much. Because the control range is divided by the intake air amount and the meaningless control is not executed in the high intake air amount operation zone where the influences of the purge are small, the drop of the purge amount can be reduced to minimum. By the way, even when the ratio of the fixed purge flow amount is increased, purge from the canister is always carried out.

Figure 30:
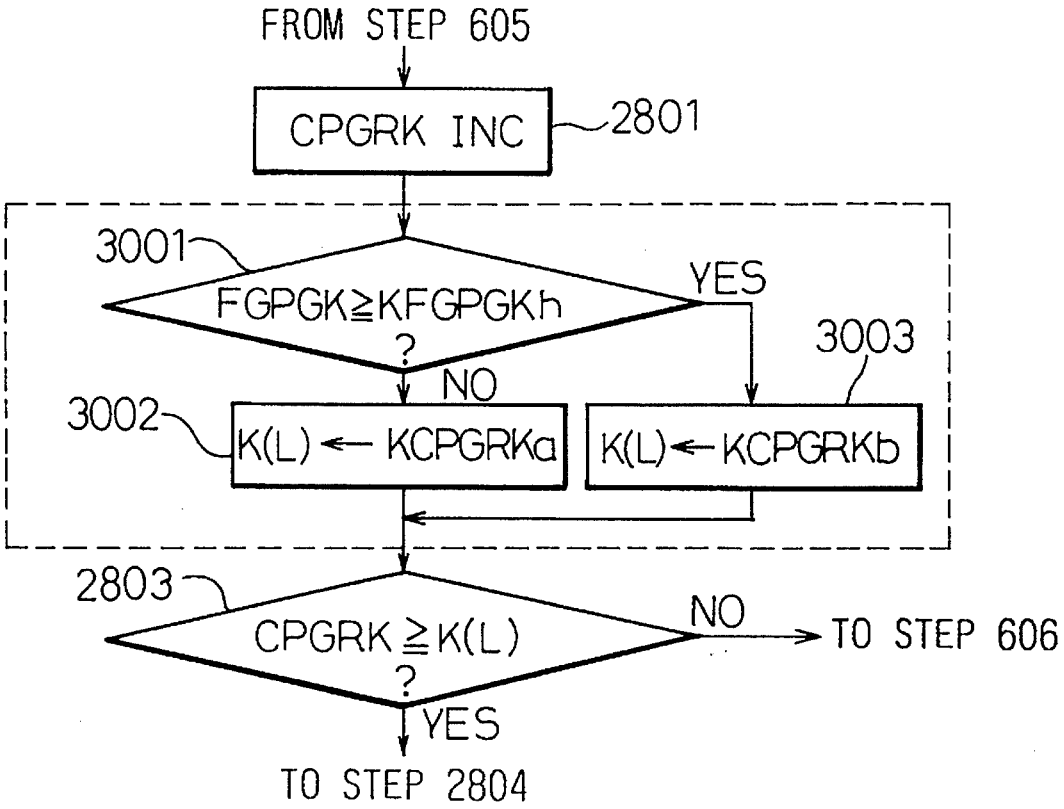
FIG. 30 is a flowchart showing the control of the eleventh embodiment of the present invention, and showing the case where a part of the fixed purge control routine explained with reference to FIG. 28 is changed.

FIG. 30 shows the control according to the eleventh embodiment of the present invention. In this control, the control for changing the judgement time K(L) of the purge execution timer CPGRK is interposed between steps 2801 and 2803 of the fixed purge control routine explained with reference to FIG. 28. Therefore, FIG. 30 shows only the principal portions of FIG. 28, and like reference numerals are used to identify like processing steps as in FIG. 28.

In the eleventh embodiment, after the purge execution timer CPGRK on the tank side is incremented at step 28001, the flow proceeds to step 3001. At this step 3001, whether or not the vapor concentration FGPGK on the fuel tank side is greater than a predetermined concentration KFGPGh is judged. When FGPGK<KFGPGh, the flow proceeds to step 3002, and the judgement time K(L) is stored as the predetermined value KCPGRKa. The flow then proceeds to step 2803. When FGPGK≦KFGPGh, the flow proceeds to step 3003, and the judgement time K(L) is stored as a predetermined value KCPGRKb smaller than the predetermined value KCPGRKa. The flow then proceeds to step 2803. After steps 2803 et seq, the same control as the control explained in FIG. 28 are executed.

Figures 31A, 31B:
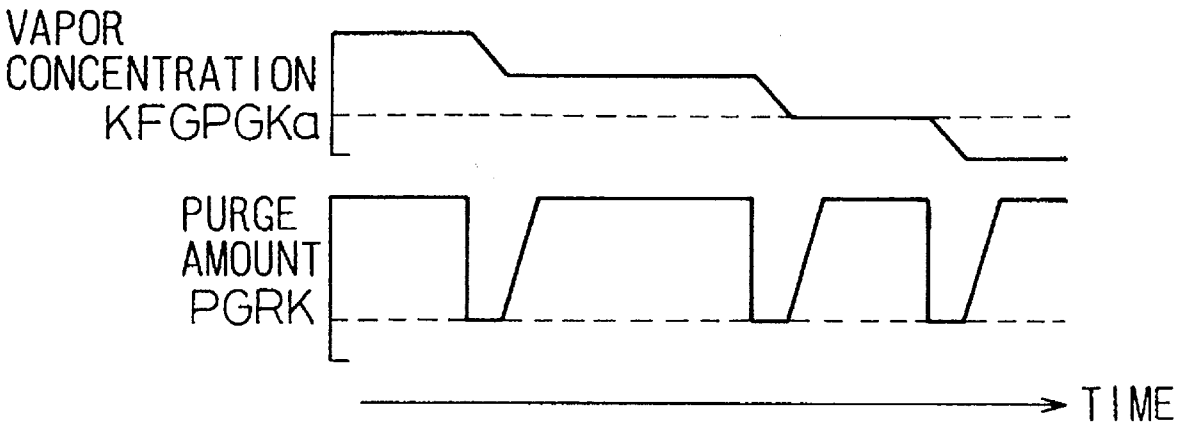
FIG. 31A is a diagram showing the change of the vapor concentration with respect to time in the procedure of the eleventh embodiment shown in FIG. 30.
FIG. 31B is a diagram showing the change of the purge amount.

As described above, in the eleventh embodiment, setting of the specific time for increasing the ratio of the fixed flow amount is made faster (shorter) when the vapor concentration on the fixed flow side is high as shown in FIG. 31. In other words, the time in which the ratio of the fixed flow amount by reducing the flow amount of the purge is changed in accordance with the vapor concentration. This is because leaning on the tank side is made faster as the change of the concentration is faster when the concentration is higher. As a result, learning of the fixed flow amount vapor concentration can be updated with high accuracy and faster when the vapor concentration is higher at which the change of the vapor concentration on the fixed flow amount side is great. Thus, prevention of erroneous air-fuel ratio can be executed while minimizing the drop of the purge amount.

Figure 32:
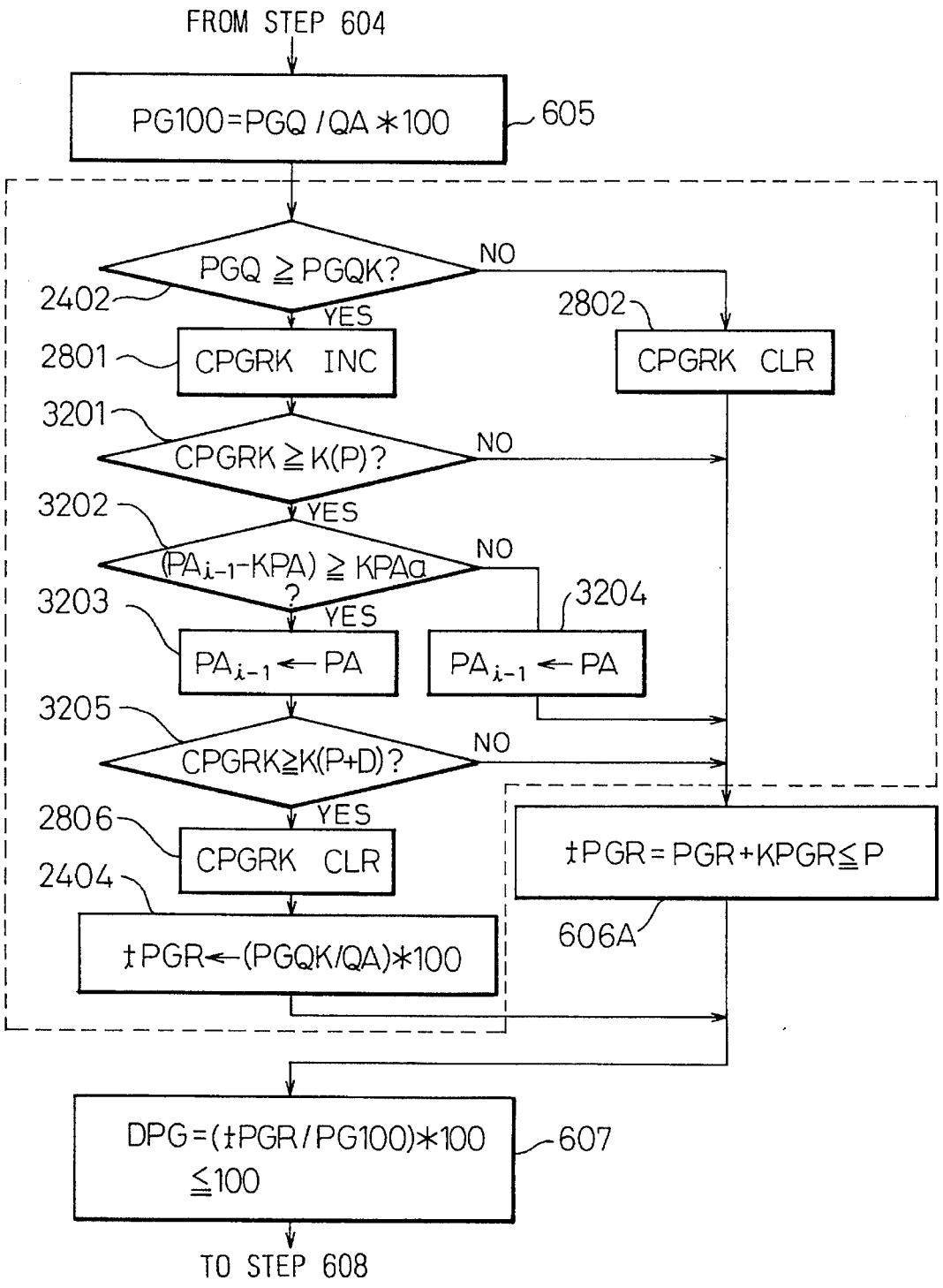
FIG. 32 is a flowchart showing the control of the twelfth embodiment of the present invention, and showing the case where a part of the fixed purge control routine explained with reference to FIG. 28 is changed.

FIG. 32 shows the control of the twelfth embodiment of the present invention. In this embodiment, the processing from steps 2803 to 2805 of the fixed purge control routine explained with reference to FIG. 28 are changed to the processing of steps 3201 to 3205. Therefore, like reference numerals are used in FIG. 32 to identify the same processing steps as in FIG. 28.

In the twelfth embodiment, the purge execution timer CPGRK on the tank side is incremented at step 2801, the flow proceeds to step 3201. At this step 3201, whether or not the purge execution timer CPGRK on the tank side is greater than the predetermined time K(P) is judged, and when CPGRK<K(P), the flow proceeds to step 606A. When CPGRK≧K(L), the flow proceeds to step 3202. At this step 3202, the change of the atmospheric pressure is obtained by subtracting the detection value PA of the atmospheric pressure this time from the detection value PAi−1 of the pressure last time, and whether or not this change of the atmospheric pressure is greater than the predetermined pressure KPAh is judged. When (PAi−1)−PA< KPAa, that is, when the atmospheric pressure does not much drop, the detection value PA of the atmospheric pressure this time is stored as the detection value PAi−1 of the atmospheric value of the last time at step 3204, and the flow proceeds to step 606A. On the other hand, when (PAi−1)−PA≧KPAa, that is, when the atmospheric pressure greatly drops, the detection value PA of the atmospheric pressure this time is stored as the detection value PAi−1 of the atmospheric pressure of the last time at step 3203, and the flow then proceeds to step 3205.

At step 3205, whether or not the purge execution timer CPGRK on the tank side is the predetermined time K(P+D) greater than the predetermined time K(P), is judged, and when CPGRK<K(P+D), the flow proceeds as such to step 606A. When CPGRK≧K(P+D), the purge execution timer CPGRK on the tank side is cleared at step 2806, and the flow proceeds to step 2404. At this step 2404, the target purge ratio tPGR is set in accordance with the following formula and the flow then proceeds to step 607:

$$tPGR=(PGQK/QA)\times 100$$

Since the processing at steps 606A and 607 has already been explained, the explanation will be hereby omitted.

The vapor generation amount from the fuel tank changes not only with the change of the fuel temperature but also with the relative change of the internal pressure of the fuel tank resulting from the change of the atmospheric pressure. In other words, the vapor generation amount from the fuel tank is determined solely by the calorie received in the case of a flatland, but because the atmospheric pressure becomes lower in a highland, the internal pressure of the tank becomes higher than at the flatland. Therefore, in this embodiment, the vapor concentration is learned when the condition is reached where the atmospheric pressure changes, so that learning can be made on the fixed flow amount side. To this aim, the change of the atmospheric pressure from the predetermined previous time is detected for each predetermined time K(P), and when the change of the atmospheric pressure becomes smaller than the specific time, the purge flow amount is reduced for a certain time.

Figures 33A, 33B:
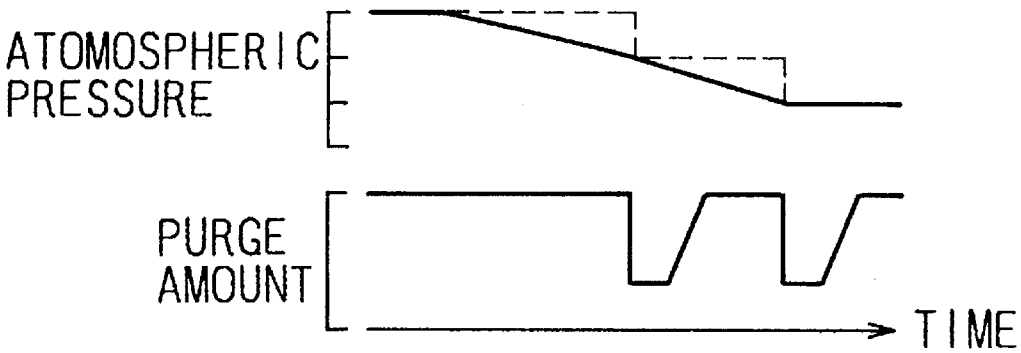
FIG. 33A is a diagram showing the change of an atmospheric pressure with respect to time in the procedure of the twelfth embodiment shown in FIG. 32.
FIG. 33B is a diagram showing the change of the purge amount.

As a result, when the car moves to the highland through a steep slope, etc., and the change occurs in the vapor generation amount inside the tank due to the abrupt drop of the atmospheric pressure as shown in FIG. 33A, the purge amount is reduced as shown in FIG. 33B, so that accuracy of the vapor concentration on the fixed flow amount side can be maintained and coarseness of the air-fuel ratio can be prevented.

Figure 34:
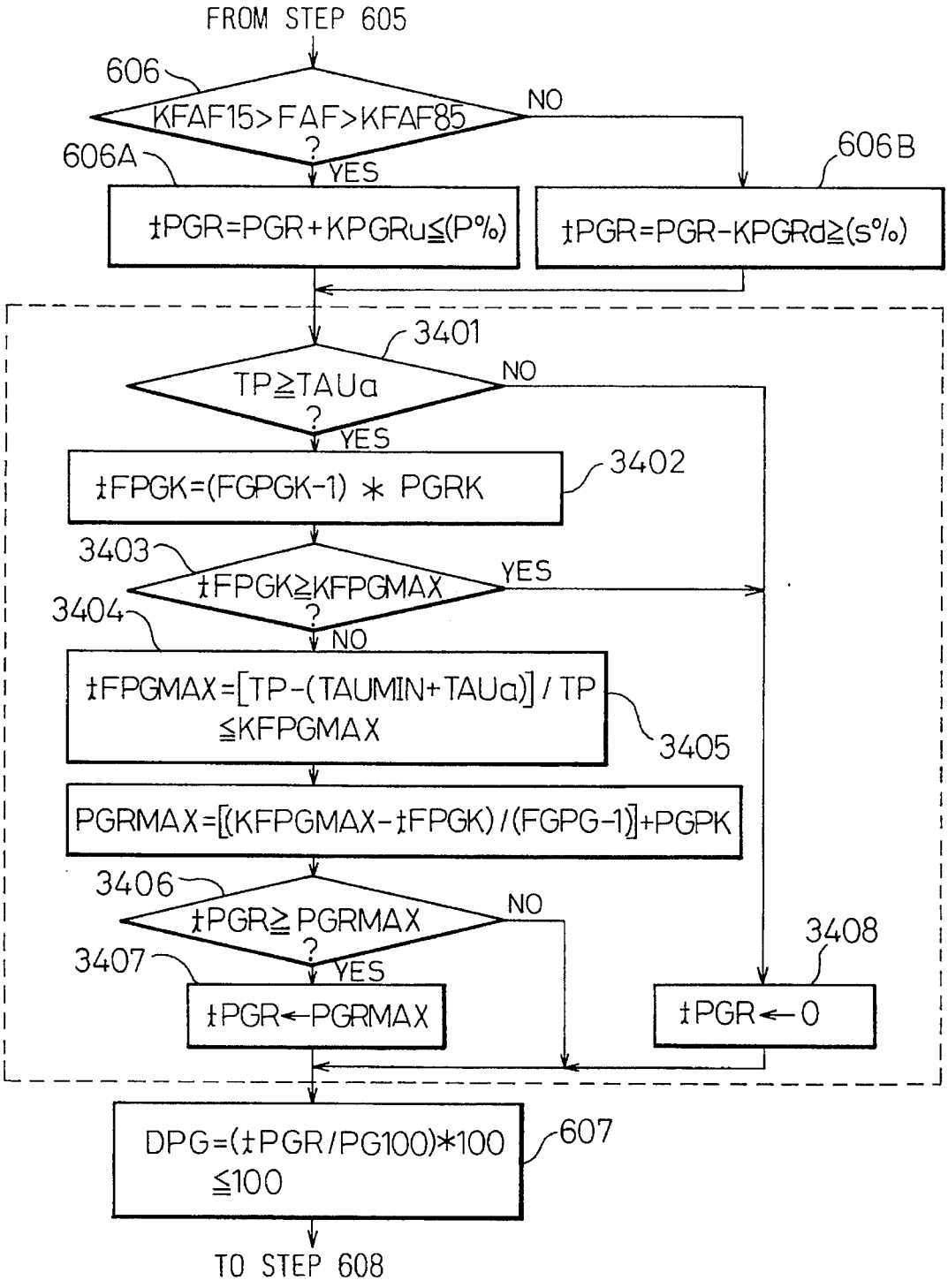
FIG. 34 is a flowchart showing the control of the thirteenth embodiment of the present invention, and showing the case where a part of the purge control routine explained with reference to FIG. 6 is changed.

FIG. 34 shows the control of the thirteenth embodiment of the present invention. In this embodiment, limit purge ratio control form steps 3401 to 3408 is inserted between steps 606A, 606B and step 607 of the purge control routine explained with reference to FIG. 6. Therefore, FIG. 34 shows, in extraction, the principal portions of the control procedure of FIG. 6, and like reference numerals are used in FIG. 34 to identify like process steps as in FIG. 6.

In the thirteenth embodiment, setting of the target purge ratio tPGR is made at step 606A or 606B, and whether or not the basic fuel injection amount TP is greater than the predetermined fuel injection amount TAUa is judged at step 3401. When TP<TAUa, the flow proceeds to step 3408, and when TP≧TAUa, the flow proceeds to step 340Z. At step 3402, the correction amount tFPGK on the fixed flow amount side is calculated in accordance with the following formula:

$$tFPGK=(FGPGK-1)\times PGRK$$

At subsequent step 3403, it is determined whether or not the correction amount tFPGK is larger than or equal to the predetermined value KFPGMAX. When tFPGK< KFPGMAX, the control proceeds to step 3408 and when fFPGK≧KFPGMAX, the conttol proceeds to step 3404. At step 3404, the correction limit value tFPGMAX of the fuel injection amount TAU is calculated in accordance with the following formula $$tFPGMAX=[TP-(TAUMIN+TAUa)]/TP\leqq KFPGMAX$$

The limit purge ratio PGRMAX is then calculated at step 3405 in accordance with the following formula:

$$PGRMAX=[(KFPGMAX-tFPGK)/(FGPG-1)]+PGRK$$

At steps 3406 and 3407, the target purge ratio is guarded by the maximum target purge ratio PGRMAX. In other words, whether or not the target purge ratio tPGR is greater than the maximum targent purge ratio PGRMAX is judged at step 3406, and when tPGR<PGRMAX, the flow proceeds as such to step 607. When tPGR≧PGRMAX, the target purge ratio tPGR is guarded by the maximum target purge ratio PGRMAX at step 3407, and the flow then proceeds to step 607.

On the other hand, when the flow proceeds from step 3401 or 3402 to step 3408, the target purge ratio tPGR is set to 0 at step 3408 and the flow then proceeds to step 607. Since the control at step 607 and after this step 607 has already been explained, the explanation will be omitted.

The limit purge ratio control in the thirteenth embodiment will be explained. When the vapor collected in the canister or the vapor from the fuel tank is purged and is introduced into the intake passage of the internal combustion engine, the internal combustion engine side learns the vapor concentration and corrects the air-fuel ratio. When the vapor enters the intake system due to this purging, the fuel injection amount TAU becomes essentially smaller so as to keep the same air-fuel ratio. Under a certain condition, however, there is the case where the fuel injection amount TAU from the fuel injection valve becomes smaller than the minimum fuel injection amount TAUMIN which must be at least secured, due to the vapor introduced into the intake system by purging.

When the proportion of the vapor amount to the fuel injection amount becomes great and the fuel injection amount TAU becomes smaller than the minimum fuel injection amount TAUMIN in this way, the engine transiently becomes unstable. Therefore, the purge amount must be controlled lest the fuel injection amount TAU from the fuel injection valve drops down to the minimum fuel injection amount TAUMIN when the vapor due to purging enters the intake system of the internal combustion engine. The limit purge ratio control sets the limit to the purge amount, restricts the vapor amount introduced into the engine by purging within a certain purge amount, and prevents deterioration of drivability. Within the purge limit, coarseness of the air-fuel ratio can be substantially eliminated by purge air-fuel ratio correction.

Figures 35A, 35B, 35C:
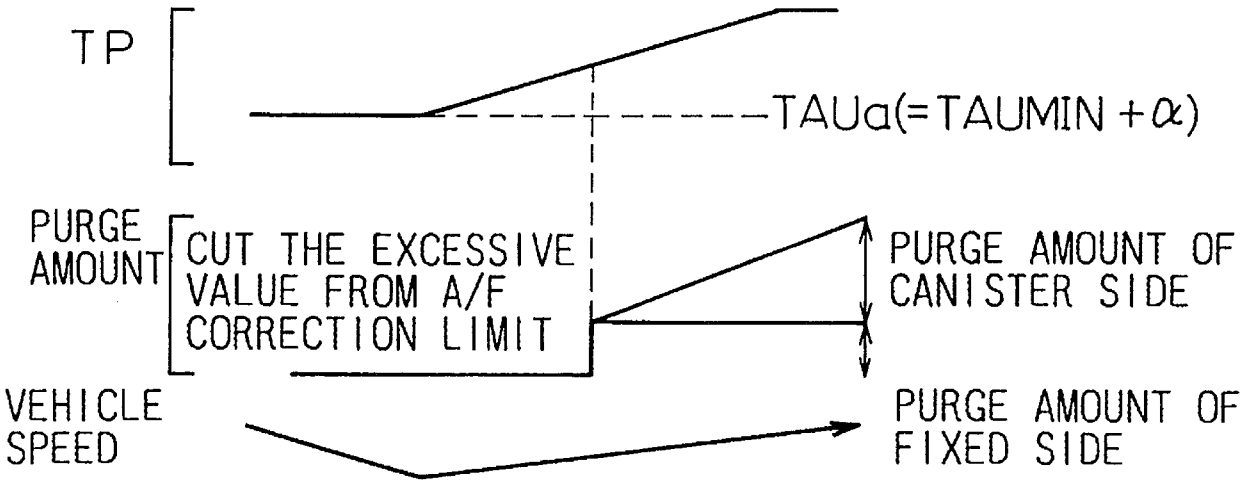
FIG. 35A is a diagram showing the change of a basic fuel injection amount with respect to time in the procedure of the thirteenth embodiment shown in FIG. 34.
FIG. 35B is a diagram showing the change of the purge amount.
FIG. 35C is a diagram showing the change of the car speed.

In the limit purge ratio control, the flow proceeds to step 3408, where the target purge ratio tPGR is set to 0, and purging is not executed as shown in FIG. 35B, both when the basic injection amount TP is smaller than the sum TAUa of the minimum fuel injection amount TAUMIN and a predetermined value α (NO at step 3401), and when the air-fuel ratio correction on the fixed flow side is above the limit (YES at step 3403). When the air-fuel ratio correction on the fixed flow amount side is within the limit, the fixed flow amount purge ratio that always flows in and the purge ratio on the canister side till the limit are calculated from the purge amount shown in FIG. 35B, and they are used as the target purge ratio.

To restrict the vapor amount to a certain limit value, the vapor concentration is first learned and then a purgeable amount is calculated on the basis of this vapor concentration so as to apply the guard. If the purge amount is determined so that the fuel injection amount TAU is greater than the minimum fuel injection amount TAUMIN, the maximum correction amount from the fuel injection amount can be calculated. Therefore, the maximum correction amount to the minimum fuel injection amount TAUMIN can be calculated, and the vapor can be introduced up to the amount so calculated. Because the vapor amount that can be introduced is controlled by the purge ratio, to which extent the purge ratio can be increased is calculated. Since the fixed amount on the tank side is a predetermined amount, the fixed amount and the maximum correction amount can be calculated, and the purge ratio can be obtained by dividing this maximum correction amount by the vapor concentration. The target purge ratio is controlled below this purge ratio.

As described above, in the thirteenth embodiment, purging is stopped when the tank vapor is excessive and the air-fuel ratio correction exceeds the limit, and the fuel injection amount is prevented from being controlled below the minimum fuel injection amount TAUMIN. Accordingly, controllability of the air-fuel ratio does not deriorate. Since the control is made below the limit purge ratio by the total amount of the air-fuel ratio correction on the tank side and the air-fuel ratio correction on the canister side, controllability of the air-fuel ratio can be always maintained.

Figure 36:
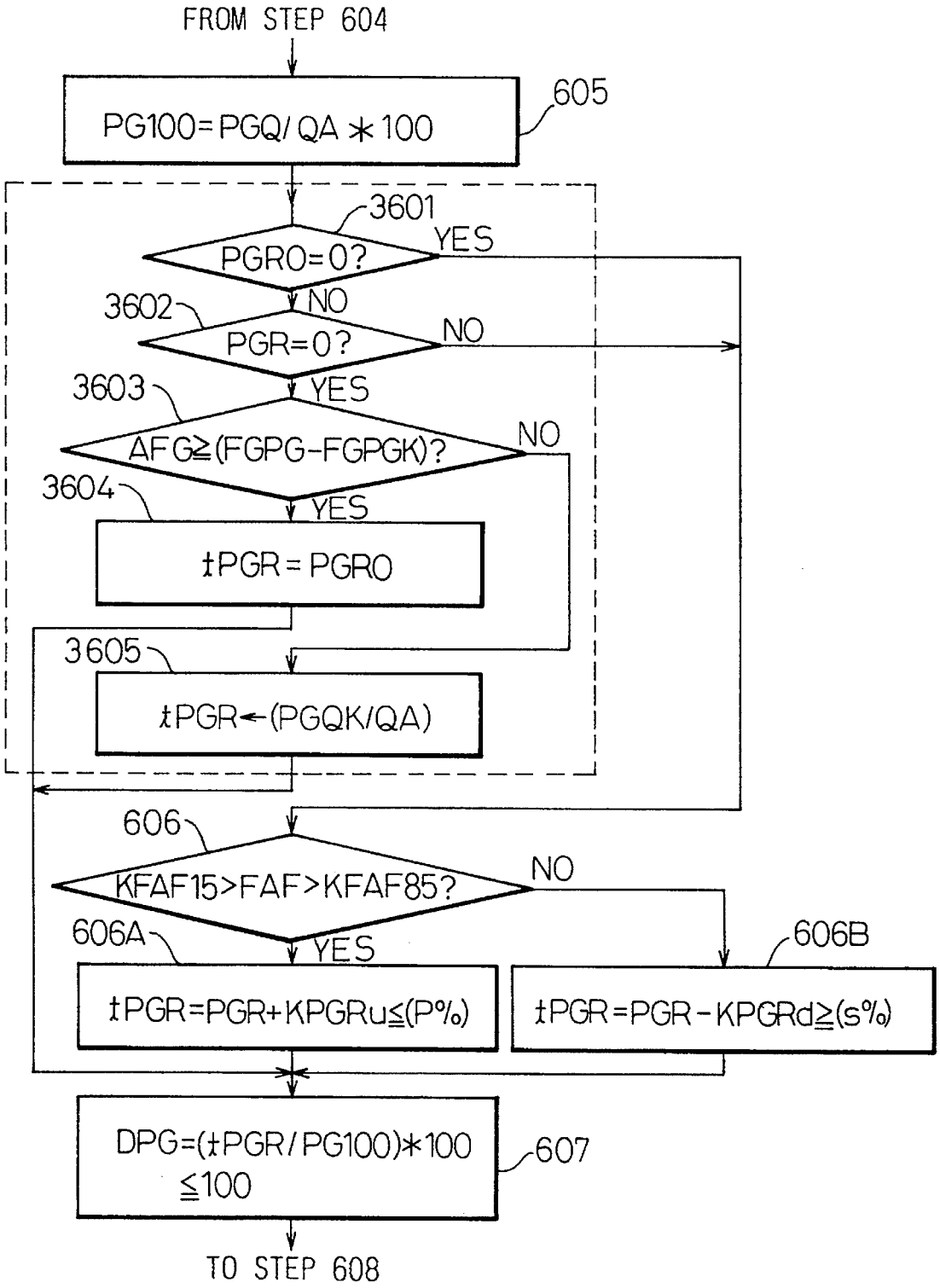
FIG. 36 is a flowchart showing the control of the fourteenth embodiment of the present invention, and showing the case where a part of the purge control routine explained with reference to FIG. 6 is changed.

FIG. 36 shows the control of the fourteenth embodiment of the present invention. In this control, the re-start purge ratio setting control represented by steps 3601 to 3605 is inserted between step 605 and steps 606, 607 of the purge control routine explained with reference to FIG. 6. Therefore, FIG. 36 shows in extraction the principal portions of the control procedure of FIG. 6, and like reference numerals are used to identify like process steps as in FIG. 6.

In the fourteenth embodiment, after the purge ratio PG100 when the D-VSV 26 is fully open is calculated at step 605, whether or not the previous purge ratio PGR0 is 0 is judged at step 3601. This is to judge whether or not purging was cut the last time. The purge ratio PRG0 of the last time is updated evertime at step 609 in FIG. 6. When PGR0=0, the flow proceeds to step 606 and when PGR0≠0, the flow proceeds to step 3602. At step 3602, whether or not the present purge ratio is 0 is judged, and when PGR≠0, the flow proceeds to step 606. When PGR=0, the flow proceeds to step 3603. It is when purging has already been executed and the purge ratio is 0 at present that the flow proceeds to step 3603.

At step 3603, whether or not the difference between the vapor concentration FGPG on the canister side and the vapor concentration FGPGK on the tank side is smaller than a predetermined value ΔFG is judged, and when ΔAFG< FGPG–FGPGK, the flow proceeds to step 3604, regarding that the vapor generation amount of the tank side is low, and when ΔFG≧FGPG–FGPGK, the flow proceeds to step 3605 regarding that the vapor generation amount of the tank side is high. At step 3604, the target purge ratio tPGR is set to the purge ratio PGR0 before purging is cut, and the flow proceeds to step 607. At step 3605, the target purge ratio tPGR is set in accordance with the following formula and the flow proceeds to step 607:

$$tPGR=(PGQK/QA)$$

The processing at steps 606 and 607 has already been explained, and the explanation will be therefore omitted.

The fourteenth embodiment relates to the control when fuel cut is effected as the engine enters the deceleration state, etc., when the vapor generation amount from the fuel tank is great. Purge is stopped simultaneously with fuel cut. Accordingly, the vapor stays in the canister during fuel cut under the condition where the vapor generation quantity from the fuel tank is great. Then, since the vapor concentration on the canister side is high when purge is next re-started, purge is under the dense state and the air-fuel ratio deviates. The fourteenth embodiment is therefore directed to prevent disturbance of the air-fuel ratio at the time of re-start of purge after fuel cut.

Whether or not purge is under the cut state is judged at steps 3601 and 3602. When the purge condition is satisfied the last time and the purge ratio PGR0 is 0 and moreover, when the purge ratio is 0 this time, the flow proceeds to step 3603, and whether or not the vapor generation amount is great is judged as the purge restart condition. When the vapor generation amount from the tank is great, the flow proceeds to step 3605 and purge is restarted from the fixed purge amount. When the vapor generation amount from the tank is small, on the contrary, the flow proceeds to step 3604, and purge is restarted from the purge ratio PGR0 of the last time.

Figures 37A, 37B, 37C:
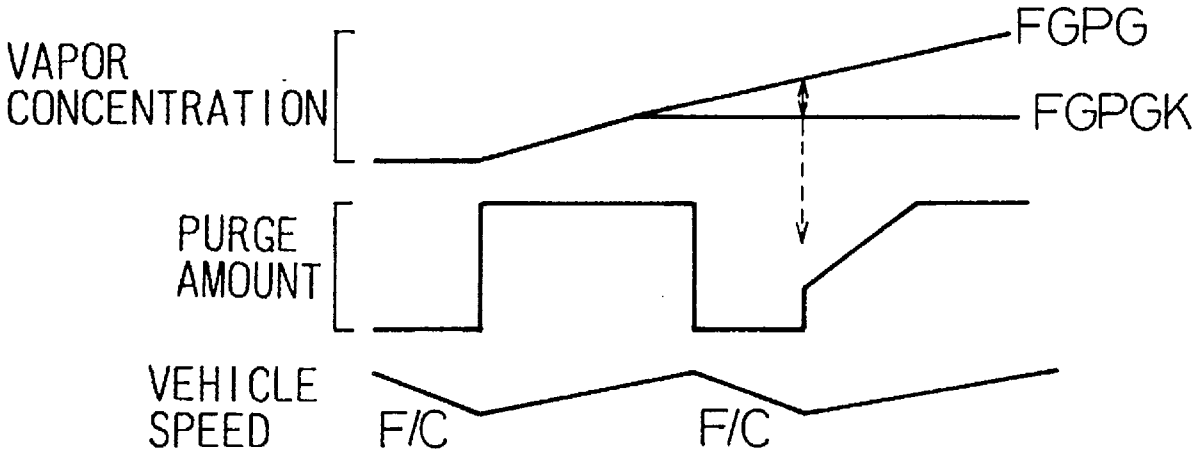
FIG. 37A is a diagram showing the change of the vapor concentration with respect to time in the procedure in the fourteenth embodiment shown in FIG. 36.
FIG. 37B is a diagram showing the change of the purge amount.
FIG. 37C is a diagram showing the change of the car speed.

FIGS. 37A to 37C show the purge re-start state from the small purge amount state when the vapor generation amount form the tank is small when fuel cut is made at the first deceleration, to increase the purge amount, but when fuel cut is made at the next deceleration, the vapor generation amount from the tank is great and the purge amount is small.

Figure 38:
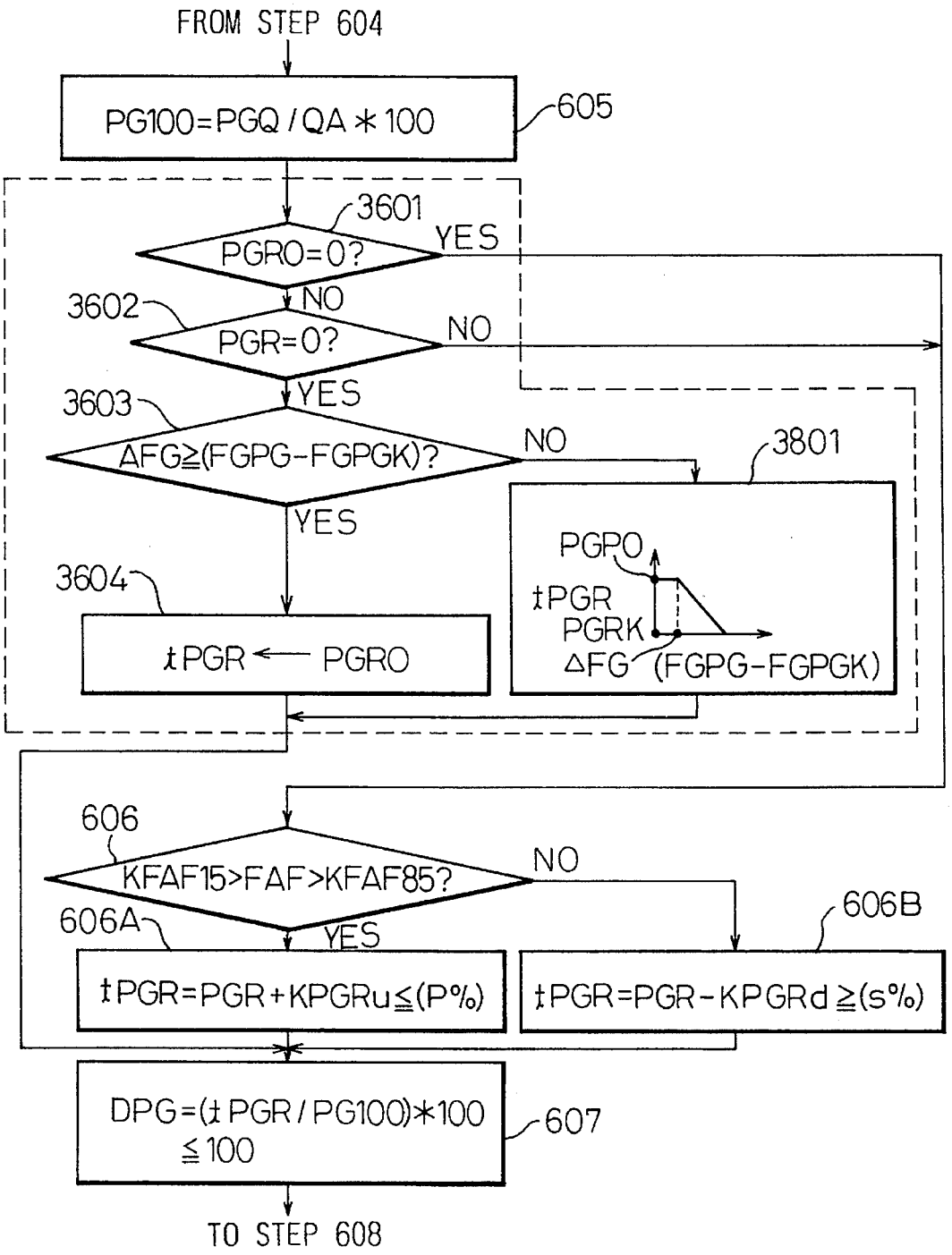
FIG. 38 is a flowchart showing the control of the fifteenth embodiment of the present invention, and showing a modified embodiment of a reopening purge ratio set control explained with reference to FIG. 36.

FIG. 38 shows the control of the fifteenth embodiment of the present invention. This control is a modified embodiment of the re-start purge ratio setting control explained with reference to FIG. 36. The only difference of this embodiment from the fourteenth embodiment lies in that step 3605 in FIG. 36 is replaced by step 3801 in FIG. 38. Therefore, like reference numerals are used in FIG. 38 to identify like process steps as in FIG. 36 and the explanation will be given on only the different portion without the explanation of the overlapped portions.

In the fourteenth embodiment shown in FIG. 36, when the vapor generation amount from the tank is judged as great at step 3603, the flow proceeds to step 3605, and purge is restarted from the fixed purge amount. In the fifteenth embodiment shown in FIG. 38, on the other hand, when the vapor generation amount form the tank is judged as great at step 3603, the flow proceeds to step 3801 and the target purge ratio is determined from the characteristic diagram of the target purge ratio tPGR with respect to the difference between the vapor concentration on the canister side and the vapor concentration on the tank side (FGPG–FGPGK), and purge is restarted on the basis of this target purge ratio tPGR. In other words, when the difference (FGPG–FGPGK) between the vapor concentration on the canister side and the vapor concentration on the tank side is slightly greater than the predetermined value ΔFG, purge is restarted from a value slightly smaller than the previous purge ratio PGR0. When the difference (FGPG–FGPGK) between the vapor concentration on the canister side and the vapor concentration on the tank side is slightly greater than the predetermined value ΔFG, purge is restarted from a value approximate to the fixed purge amount PGRK.

Figures 39A, 39B, 39C:
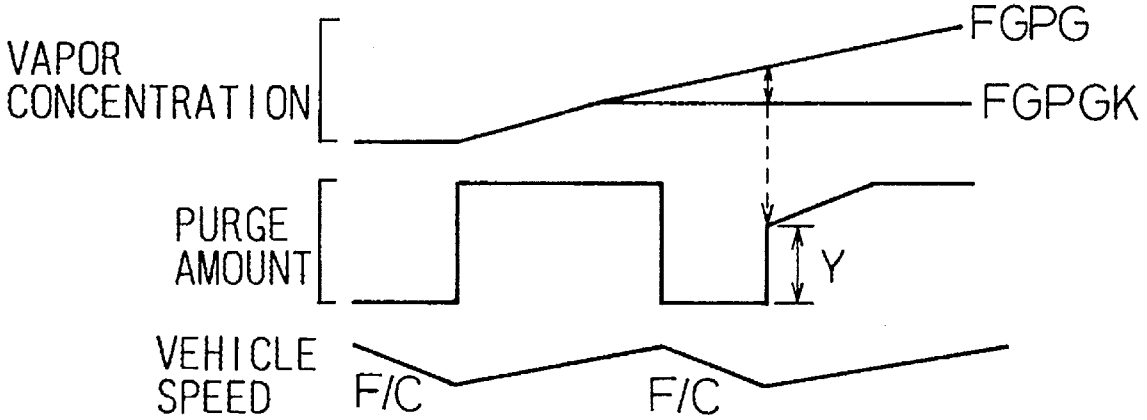
FIG. 39A is a diagram showing the change of the vapor concentration with respect to time in the procedure of the fifteenth embodiment shown in FIG. 38.
FIG. 39B is a diagram showing the change of the purge amount.
FIG. 39C is a diagram showing the change of the car speed.

By the way, the change of the vapor concentration on the canister side during purge cut is determine by the purge cut time besides the amount of the tank vapor. Therefore, the purge cut time may be used as the abscissa of the characteristic diagram of step 3801. According to the control of the fifteenth embodiment, the value of the purge amount Y at the second re-start of the purge shown in FIG. 39B changes with the difference of the vapor concentrations between the vapor concentration on the canister side and the vapor concentration on the tank side, or with the purge cut time.

According to the fifteenth embodiment, the purge amount can be increased while restricting coarseness of the air-fuel ratio at the re-start of the purge after purge cut.

As explained with reference to various embodiments, the fuel injection amount correction apparatus for the internal combustion engine according to the present invention determines the anticipated correction amount of the fuel injection amount by considering not only the change of the purge amount of the vapor from the canister side but also the change of the purge amount of the vapor from the fuel tank side, and calculates the correction amount of the fuel injection amount by this anticipated correction amount. Accordingly, air-fuel ratio control can be executed with a high level of accuracy.

What is claimed is:

1. An apparatus for correcting an amount of fuel injection, disposed inside an internal combustion engine the amount of fuel injection of which is calculated by air-fuel ratio feedback control means and the air-fuel ratio of which is controlled by the amount of fuel injection so calculated, for calculating an anticipated correction amount of the amount of fuel injection in accordance with vapor fuel amounts purged from a canister and from a fuel tank and correcting the amount of fuel injection by said anticipated correction amount, comprising:

a canister having a tank port into which a vapor fuel generated in a fuel tank flows through a vapor passage, a purge port for purging the vapor fuel into an intake passage of said internal combustion engine through a purge passage and an atmospheric port communicated with the atmosphere, wherein said tank port and said purge port are communicated through a relay chamber and a trapping material of said vapor fuel is interposed between said relay chamber and said atmospheric port;

a control valve disposed at an intermediate part of said purge passage, and capable of adjusting the passage area of said purge passage by changing an opening thereof;

tank side correction amount calculation means for calculating a correction amount of the amount of fuel injection for correcting an air-fuel ratio which changes when the vapor fuel generated in said fuel tank is directly supplied to said intake passage through said control valve;

canister side correction amount calculation means for calculating a correction amount of the amount of fuel injection which changes when the vapor fuel emitted from said trapping material of said canister is supplied to said intake passage through said control valve; and anticipated correction amount calculation means for inputting an opening signal from said control valve and the correction amounts of the amounts of fuel injection from both of said tank side correction amount calculation means and said canister side correction amount calculation means, and anticipating the correction amount of the amount of fuel injection after opening of said control valve changes, on the basis of said correction amount on the tank side and the correction amount on the canister side.

2. An apparatus as set forth in claim 1, wherein said tank side correction amount calculation means includes tank side concentration learning means for determining a proportion of an air-fuel mixture generated in said tank and directly passing through said control valve, learning a tank side vapor concentration and calculating a tank concentration learning value;

said canister side correction amount calculation means includes canister side concentration learning means for determining the proportion of an air-fuel mixture once coming off from said canister and passing through said control valve, learning a canister side vapor concentration and calculating a canister concentration learning value; and said anticipated correction amount calculation means anticipates said correction amount on the basis of a tank side learning value and a canister side learning value which are updated by said two learning means, and on the basis of the proportion of the origins of said air-fuel mixtures.

3. An apparatus as set forth in claim 2, wherein said tank side concentration learning means updates said tank concentration learning value during an idle operation of said engine.

4. An apparatus as set forth in claim 2, wherein said tank side concentration learning means updates said tank concentration learning value when the vapor amount from said tank is great.

5. An apparatus as set forth in claim 2, wherein said tank side concentration learning means increases the anticipated value of the proportion of the air-fuel mixture on the tank side with the increase of the opening of said control valve.

6. An apparatus as set forth in claim 5, wherein said tank side concentration learning means gradually changes the anticipated value of the proportion of the air-fuel mixture on said tank side.

7. An apparatus as set forth in claim 2, wherein said anticipated correction amount calculation means inhibits said tank side concentration learning means from learning the tank concentration, or reduces the anticipated value of the proportion of the air-fuel mixture from said tank side.

8. An apparatus as set forth in claim 7, wherein said tank side concentration learning means gradually changes the anticipated value of the proportion of the air-fuel mixture on said tank side.

9. An apparatus as set forth in claim 2, wherein said tank side concentration learning means makes variable the anticipated value of the proportion of the air-fuel mixture on said tank side in accordance with a changing direction of a detection value of an air-fuel ratio of an oxygen sensor disposed in the exhaust passage of said internal combustion engine.

10. An apparatus as set forth in claim 9, wherein said tank side concentration learning means gradually changes the proportion of the air-fuel mixture on said tank side.

11. An apparatus as set forth in claim 2, wherein said tank side concentration learning means calculates the anticipated value of the amount of the air-fuel mixture from said tank side from a change amount of a detection value of an air-fuel ratio by said oxygen sensor on the basis of the vapor concentration on said tank side which is set in advance.

12. An apparatus as set forth in claim 2, which further comprises tank side vapor concentration rate increasing means for increasing the vapor concentration rate on said tank side by setting said control valve to the closure side for a predetermined period of the operation condition of said internal combustion engine, and wherein said tank side concentration learning means executes the vapor concentration calculation on said tank side on the basis of the anticipated value of the air-fuel mixture from said tank side which is increased by said tank side vapor concentration rate increasing means.

13. An apparatus as set forth in claim 12, wherein said tank side concentration rate increasing means increases said predetermined period with the increase of the tank side vapor concentration.

14. An apparatus as set forth in claim 2, which further comprises atmospheric pressure change detection means, and wherein said tank side concentration learning means changes the anticipated value of the proportion of the air-fuel mixture from said tank side in accordance with the change of the atmospheric pressure detected by said atmospheric pressure change detection means.

15. An apparatus as set forth in claim 12, which further comprises tank side vapor concentration rate reduction means for reducing the vapor concentration rate on said tank side by setting said control valve to the open side for a predetermined period after said tank side concentration learning means calculates the tank concentration learning value, and wherein said tank side concentration learning means calculates the canister concentration on the basis of the anticipated value of the proportion of the air-fuel mixture from said tank side reduced by said tank side vapor concentration rate reduction means.

16. An apparatus as set forth in claim 2, which further comprises limit purge amount setting means for setting a maximum vapor fuel amount introduceable into said intake system in accordance with the operation condition of said internal combustion engine, and control valve driving means for driving said control valve in accordance with said set value, the anticipated value of the proportion of the air-fuel mixture from said tank side, said tank concentration learning value and said canister concentration learning value.

17. An apparatus as set forth in claim 1, which further comprises:

control valve closure time detection means for detecting the duration time of the fully closed state of said control valve during the operation of said engine;

purge re-execution detection means for detecting re-start of execution of purge after the fully closed state lasts for a predetermined time; and control valve purge re-start opening control means for setting the opening of said control valve to the closure side in accordance with the vapor concentration on said tank side for a predetermined period at the re-start of execution of said purge.

18. An apparatus as set forth in claim 17, wherein said purge re-start opening control means sets the opening of said control valve to a smaller value when the duration time of the fully closed state of said control valve is longer.

* * * * *

UNITED STATES PATENT AND TRADEMARK OFFICE

CERTIFICATE OF CORRECTION

PATENT NO. : 5,497,757
DATED : March 12, 1996
INVENTOR(S) : Akinori OSANAI

It is certified that error appears in the above-indentified patent and that said Letters Patent is hereby corrected as shown below:

Column 3, line 17, delete "10" before "proportion".

Figures 13A, 13B, 13C:
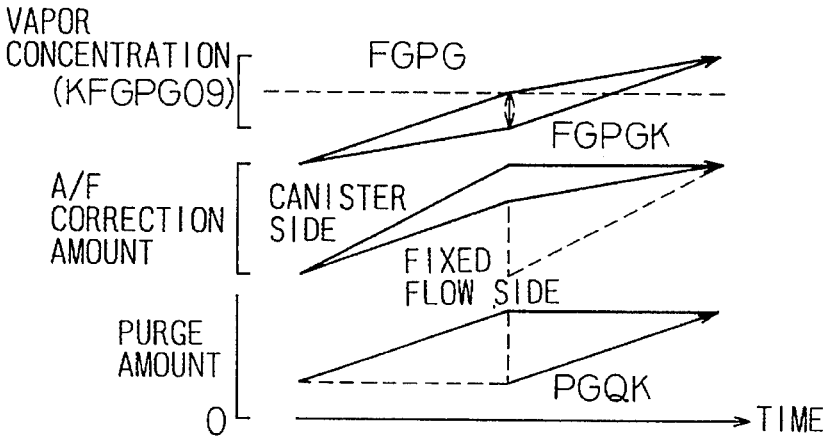
FIG. 13A is a diagram showing the change of the vapor concentration with respect to time on the basis of the procedure of the second embodiment shown in FIG. 12.
FIG. 13B is a diagram showing the change of an air-fuel ratio correction amount.
FIG. 13C is a diagram showing the change of the purge amount.

Column 4, line 56, delete "10" after "FIG. 8;" and start "FIG. 13A" as new paragraph.

Column 5, line 4, insert --a-- before "diagram".

Column 5, line 25, delete "10" at beginning of line and start "FIG. 20" as new paragraph.

Column 8, line 58, change "form" to --from--.

Column 9, line 32, delete "this" before "routine".

Column 11, line 59, change "staring," to --starting,--.

Column 12, line 24, change "deriod" to --period--.

Column 17, line 22, change "umerals" to --numerals--.

Column 18, line 37, change "no" to --not--.

Column 20, line 21, change "an be" to --can be--.

Column 20, line 30, change "mich" to --such--.

UNITED STATES PATENT AND TRADEMARK OFFICE

CERTIFICATE OF CORRECTION

PATENT NO. : 5,497,757

DATED : March 12, 1996

INVENTOR(S) : Akinori OSANAI

It is certified that error appears in the above-indentified patent and that said Letters Patent is hereby corrected as shown below:

Column 23, line 12, change "AT" to --At--.

Column 27, line 33, change "targent" to --target--.

Column 28, line 14, change "till" to --until--.

Column 28, line 58, change "evertime" to --everytime--.

Column 29, line 2, change "∆AFG∠" to --∆FG∠--.

Column 30, line 12, change "determine" to --determined--.

Signed and Sealed this

Twenty-seventh Day of August, 1996

Bruce Lehman

*Attest:*

BRUCE LEHMAN

*Attesting Officer*

*Commissioner of Patents and Trademarks*